US007980044B2

(12) United States Patent
Brewka et al.

(10) Patent No.: US 7,980,044 B2
(45) Date of Patent: Jul. 19, 2011

(54) METHOD FOR FORMING CAST-IN-PLACE CONCRETE WINDOW WELLS

(75) Inventors: Roman Brewka, St. Joseph, MO (US); Julious Durwood Kaeding, Independence, MO (US); Ronald A. Ward, Leawood, KS (US); Larry D. Austin, Independence, MO (US); Leslie E. Howard, Lenexa, KS (US); Kenneth S. Chastain, Polo, MO (US)

(73) Assignee: Western Forms, Inc., Kansas City, MO (US)

( * ) Notice: Subject to any disclaimer, the term of this patent is extended or adjusted under 35 U.S.C. 154(b) by 720 days.

(21) Appl. No.: 12/016,142

(22) Filed: Jan. 17, 2008

(65) Prior Publication Data

US 2008/0216420 A1 Sep. 11, 2008

Related U.S. Application Data

(60) Provisional application No. 60/885,355, filed on Jan. 17, 2007.

(51) Int. Cl.
*E04G 21/02* (2006.01)

(52) U.S. Cl. ..... 52/745.15; 264/35

(58) Field of Classification Search ..... 52/745.15, 52/745.16, 745.05, 745.09, 745.1, 745.13, 52/107; 264/31, 35; 249/39
See application file for complete search history.

(56) References Cited

U.S. PATENT DOCUMENTS

| | | | | |
|---|---|---|---|---|
| 1,028,013 | A * | 5/1912 | Fuller | 249/27 |
| 1,175,044 | A * | 3/1916 | Braun | 249/27 |
| 1,579,822 | A * | 4/1926 | Knickerbocker | 249/27 |
| 7,144,530 | B2 | 12/2006 | Ward et al. | |
| 2010/0095611 | A1 * | 4/2010 | Antonic | 52/210 |

OTHER PUBLICATIONS

Western Forms Product Catalog, 2004-2006, selected pages (25 pages).
Western Forms, Inc. Chart entitled "Systems Application Chart", printed in 2005 (2 pages).

* cited by examiner

*Primary Examiner* — Michael Safavi
(74) *Attorney, Agent, or Firm* — Hovey Williams LLP

(57) ABSTRACT

A method and apparatus for forming cast-in-place window well walls includes first and second forming panel modules each having an inner and outer section. The forming panel modules may be connected together by a spacer panel which extends downwardly to a footing for providing a pier for supporting the window well wall. The forming panel modules are preferably configured with arcuate corners and upper and lower rails to permit stacking of the modules to increase the height of the window well wall, or include additional spacer panels or filler forms to increase the width or thickness of the window well wall.

3 Claims, 18 Drawing Sheets

METHOD FOR FORMING CAST-IN-PLACE CONCRETE WINDOW WELLS

This application claims the benefit of U.S. Provisional Application No. 60/885,355 filed Jan. 17, 2007.

BACKGROUND OF THE INVENTION

1. Field of the Invention

The present invention concerns a method and apparatus for forming cast-in-place concrete window wells as part of construction of a building. More particularly, it is concerned with a window well form which is adaptable for forming window wells which may be selectively varied in height, width or wall thickness.

2. Description of the Prior Art

In the construction of buildings, many homebuilders desire, or building codes require, the provision of windows in poured concrete foundation walls. Such windows admit light and ventilation, and provide a point of egress directly to the exterior. Where the windows are below the grade of the earth proximate the foundation, it is necessary to provide a clear area around the exterior of the window which extends below the grade to at or above the grade. In order to retain the earth from entering this open area, window wells are commonly used.

Heretofore, window wells have most commonly been provided of galvanized steel which are placed near or attached to the structure around the window opening before backfilling of the earth. These galvanized steel window wells are of common sizes and retained in inventory by the concrete contractor until needed for use. While relatively lightweight and thus portable, they present numerous disadvantages. For example, they are not particularly attractive, the galvanizing layer may be penetrated resulting in rusting, are limited in strength, and require a great deal of space for storage and tie up considerable inventory costs for the contractor.

Another alternative for providing a window well for a building has been to provide precast concrete window wells. These window wells are precast at a location remote from the job site and then placed around the window to create the well. While generally more corrosion resistant and somewhat more able to blend into the environment of the structure than the galvanized steel window wells, they present other problems. Their precast concrete construction makes them heavy to transport and set, and typically require off-road equipment to move and set in place. This may result in damage to the precast concrete window well during transport and placement by such equipment. They also occupy a significant amount of storage space for inventory as well as associated inventory costs. Like galvanized steel window wells, they also are typically available only in a limited number of sizes, with the result that customizing a window well for height, depth, or width requires preplanning and/or additional cost as compared to the wells of standard dimensions.

A yet further alternative which has been previously adopted to a limited extent is to cast full-length wall extensions from the foundation wall which extends down to a footing which is in a common horizontal plane with the footing of the foundation wall. This alternative in some instances of construction involves a full-length wall to be cast from the concrete opposite the window to form a window well using 90° corners and full-length forming panels, and essentially is the same process as for forming a separate, enclosed foundation wall structure extending from the foundation wall of the building, rather than a window well wall. Principal disadvantages to this type of construction include appearance, the excess weight of the wall, attendant cost of excavation, the cost of the footing necessarily extending under the forms and the resultant wall, depth of wall, and consequent material cost and labor, and the resultant waste arising from excess material and excavation.

As a result, there has developed a significant need for a more advanced window well system.

SUMMARY OF THE INVENTION

These and other advantages have largely been achieved by the apparatus and method for forming cast-in-place window wells of the present invention. While forming systems of wood or metal forms are well known, the present invention provides an easy and economical approach to the problems associated with window well construction not previously contemplated nor developed in the prior art. As a result, a window well forming system has been developed which provides not only an economical way of forming window wells at the job site which integrates in structure and appearance with the foundation walls, reduces the inventory issues of the contractor, and provides enhanced flexibility in the size of the window well and consequently the window opening, but also results in enhanced strength to the foundation wall as compared to existing window well approaches.

Broadly speaking, the present invention achieves these objects by providing forming panel modules which integrate with existing forming panels to provide a channel for forming a window well. The forming panel modules are configured to provide an attractive and correctly sized window well and to mount with conventional metal forms as a part of a forming wall system. The concrete window well forming panel systems utilizes the forming panel modules which are positioned opposite a portion of the forming wall system for the foundation wall and which provides the window opening so that concrete poured between the forms flows into the window well apparatus and integrates with the existing wall. The forming panel modules are preferably provided as pairs of module sections, typically configured as inner and outer sections, whereby a bottom rail of the modules is elevated relative to the bottom rail of the foundation wall forming panel modules. Most preferably, each section is a separate forming member which may be connected directly or indirectly to forming panels for the foundation wall, and preferably have an inboard leg which extends outwardly from the forming panels for the exterior of the foundation wall, and outboard legs which are angled with respect to the inboard leg to extend toward the outboard legs of the other module and provide a continuous concrete-receiving channel for defining the window well wall. Because the modules for forming the window well walls are in pairs, and thus separate module pairs are provided for the right and left side of the window well wall with a rail which permits them to be connected or separate, the modules permit selective adjustment of the width of the window well from a minimum width to a wider width, the minimum width being defined by the size and configuration of the inner and outer sections of the modules. In order to increase the width of the window well to be formed from a minimum width, and to provide a pier for the window well, one or several inner and outer filler forms may be positioned between the angular forming members. Preferably, the outboard legs of the module are oriented substantially parallel to the forming panels for the foundation wall, while the inboard legs are oriented at an oblique angle relative to the outboard leg and to the adjacent feet which are aligned with the forming panels of the foundation wall. An arcuate, rounded corner preferably connects the inboard leg to the outboard leg to minimize stress concentrations in the concrete window well wall formed thereby.

Advantageously, the forming panel modules are configured to accept like-configured modules atop one another, to increase the height of the window well formed thereby. Furthermore, filler panels may be inserted between the modules and the panels which form the structure wall to increase the thickness of the wall as constructed. Where desired, the forming panel modules may be constructed so as to form or receive steps to aid in ingress or egress from the window well.

Because the forming panel modules are configured to couple to and integrate with existing flat forming panels, and provide the flexibility to expand in depth, height, length and wall thickness, the inventory of the contractor is greatly reduced. In especially preferred embodiments, the modules are configured with identically shaped inner and outer sections, whereby inversion of an inner section of one module, e.g. an inner section or an outer section of a left module, will then serve as a corresponding inner or outer section of the other module, e.g. the right module. Because the resulting window well wall is integrated into the foundation wall because it is poured in place therewith, the window well wall adds dimensional strength and reinforces the wall of the foundation surrounding the window. Similarly, because in the preferred embodiments, the window well wall does not extend downwardly as far as the adjacent foundation wall and its bottom edge is elevated above the bottom of the foundation wall which is adjacent to the window well, the aforementioned problems and additional costs including those attendant to excavation, labor, and excess material are avoided. When needed, the ability to pour a pier contemporaneously with the window well avoids a cantilevered stress on the foundation wall.

The present invention also includes the ability to cast or receive steps as a part of the window well construction. In one embodiment, the inner section of a module may be configured to include a plurality of aligned boxes. The boxes are sized and configured to provide recesses in the poured concrete window well for receiving human hands and/or feet. Thus, upon removal of the window well forming system, the recesses in the formed window well permit egress or facilitate entry by emergency personnel. Alternatively, the inner sections can be configured with the boxes extending into the window well area such that instead of recesses, steps are formed which project interiorly into the window well area. Such steps also provide footing and handholds for ingress and egress, and may be positioned as site conditions dictate. Another alternative for providing steps in the window well wall contemplates the formation of hollows in the window well wall. This may be accomplished by providing the inner section of a module with bushings which are sized to receive insertable tools, preferably tapered tools. When the tools are removed from the bushing after curing of the poured concrete, the resulting hollows formed thereby may receive steps, such as U-shaped steps. The U-shaped steps may be driven into the hollows and held by gripping members to provide steps for ingress and egress.

In another alternative embodiment, the inboard leg of one or both of the inner sections and the outboard sections may be pivotally coupled to an adjacent foot which is configured for coupling and mounting to an adjacent forming panel by hinges. The use of a hinge coupling between the feet and the inboard legs facilitates installation of forming panels to the window well forming system, and provides an ability to adjust for variations in form placement or site conditions.

The present invention thus provides for an improved method of constructing structures having window openings and utilizing window wells. By providing complementally configured inner and outer sections and coupling the inner and outer sections which are coupled to forming panels proximate a window buck, a window well may be cast in place by depositing flowable concrete between the inner and outer sections. Upon removal of the window well forming system, the resulting window well is of monolithic construction as a part of the wall, such as a foundation wall, of the structure. As used herein, "monolithic" construction means that the resulting window well wall and the building wall, typically a foundation wall of a building structure, is formed by concrete which is continuous and unbroken therebetween when cured. Most preferably, the monolithic construction of the present invention includes the provision of reinforcing steel in the form of bars, mesh or the like which extends outwardly from the building wall and extends into the window well wall, such that the concrete is poured to flow from the channel between the opposing forming panels of the wall and into the channel between the opposing panels of the window well module such that the poured concrete of the building wall and the window well wall cures at the same time and is continuous. Most preferably, at least that part of the window well wall formed by the angular inner and outer sections does not extend downwardly to be on substantially a common horizontal plane with the bottom of the foundation wall reducing waste. This can be accomplished by grading below the window well forming system hereof, or more preferably, by utilizing base plates which prevent the flow of concrete downwardly out from the channel between the forming panels. When additional support is needed for a window well, the present invention also provides for a pier to be poured as a part of the window well wall and on the outboard portion of the window well wall.

As noted above, the method provides for adjusting the size and configuration of the window well to be provided on-site, and without maintaining a large inventory of window wells. That is, by adding filler panels, or by stacking modules, the window well size can be readily increased, and piering provided as a part of the construction process so that the window well thereby formed is well supported at a distance from the wall formed contemporaneously with the window well. Also, as a part of the forming process, a textured or patterned surface may be provided on the window well to complement the surface of the walls of the structure by utilizing textured or patterned at least inner, concrete receiving surfaces on the face plates of the inner, or more preferably outer sections. The method also includes the provision of steps into the inner, window-well facing surfaces of the formed window well as discussed herein.

These and other advantages will be readily appreciated by those skilled in the art with reference to the drawings and the description which follow.

DESCRIPTION OF THE PREFERRED EMBODIMENT

Figure 1:
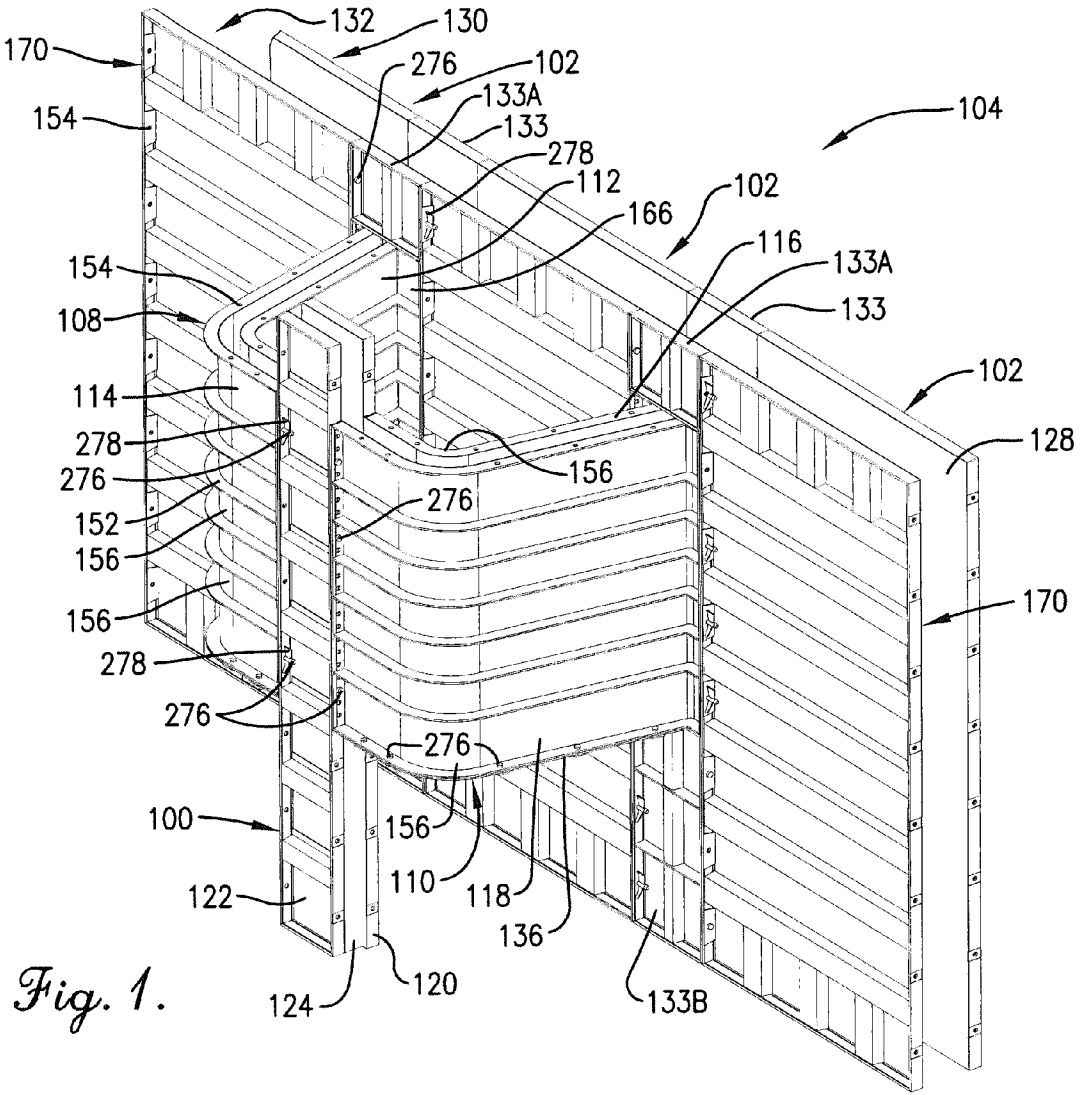
FIG. 1 is a perspective view of a forming system for a window well in accordance with the present invention, shown from the upper and outer side of the forming wall system.

Referring now to the drawings, a window well forming panel system 100 in accordance with the present invention is adapted for use with conventional interior forming wall panels 102 and exterior forming wall panels 170 (which may be the same or similar panels) to permit the construction of a poured-in-place window well wall 106 (FIGS. 7-10, 12-16 and 18-19) as part of an integrated foundation forming wall system 104. The window well forming panel system 100 includes left and right forming panel modules 108 and 110 including pairs of angular sections 112 and 114, and 116 and 118 as shown in FIG. 1. In some preferred embodiments, the window well forming panel system 100 may include spacer panels 120 and 122, filler panels 124, and base plates 126. The base plates are especially useful where the height of the window well wall 106 is to be limited so as to not extend downwardly to the same lower extent as the adjacent foundation wall. When additional support is required and when it is desired to avoid having the window well wall 106 cantilevered from the foundation wall, the spacer panels 120 and 122 and the associated filler panels may extend downwardly from the lower rail of the adjacent angular sections and their associated base plates 126 to provide a pier, or the spacer panels 120 and 122 may be only of the same vertical height as the adjacent angular sections so that the window well wall 106 formed thereby is of a substantially continuous height and preferably less than the height of the adjacent foundation wall. The integrated foundation forming wall system 104 is configured to sit atop footings poured atop or into the earth and to receive concrete or other cementations material poured into a volume 128 between two opposed forming panel walls 130 and 132 typically comprising a number of the forming panels 102 and 170 and adapter forming panels 133, 133A and 133B of desired widths and heights as shown, for example, in FIGS. 1, 2 and 11, whereby the window well wall 106 may be poured in place to integrate and be a unitary member of the foundation tied into a foundation wall 134, thereby providing a monolithic construction. The use of adapter forming panels 133B which are of a reduced height relative to the height of the forming panels 170, and their placement below and in supporting relationship to the modules 108 and 110, thus allows the modules 108 and 110 with base plates 126 to be positioned upwardly from the bottom rail of the forming panels 102 and 170 with the base plates proximate or only slightly lower than the window opening. That is to say, the adapter forming panels 133B position the modules 108 and 110 such that the bottom of the concrete window well wall 106 formed thereby is substantially elevated relative to the bottom of the foundation wall formed by the forming panels 102 and 170. In addition, the use of adapter forming panels 133A allows the upper extent or rails of the modules 108 and 110 to be below the height of the upper rail of the forming panels 102 and 170 and facilitates the pouring of a full height foundation wall without the modules 108 and 110, or the concrete window well wall formed thereby, being of the same height.

Figure 25:
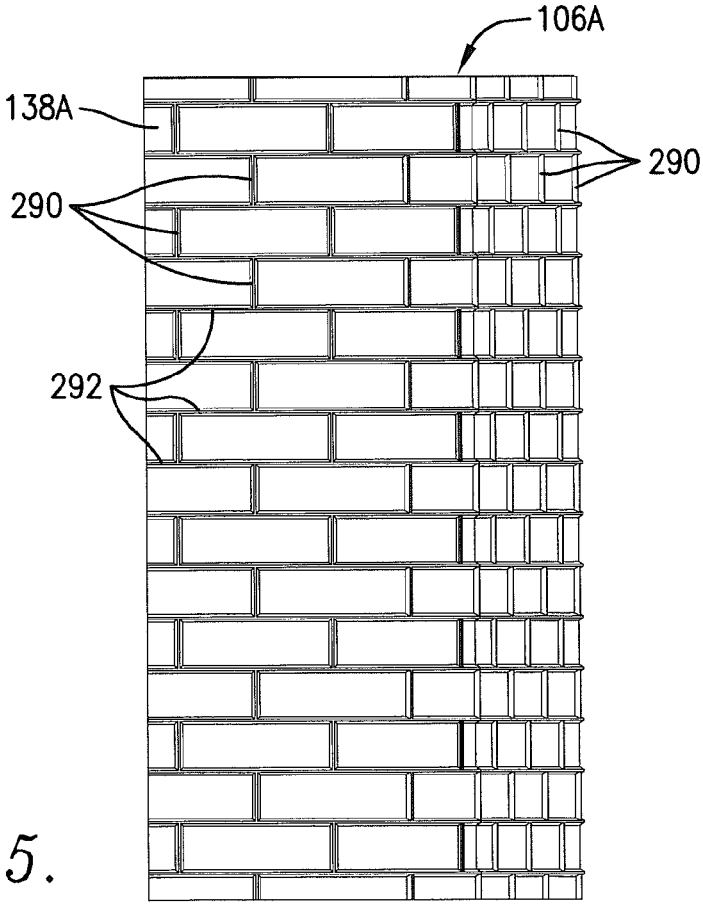
FIG. 25 is a front elevational view of the angular inner section of FIG. 24 showing a patterned concrete-receiving surface having raised segments to simulate mortar joints in a brick wall.
Figure 26:
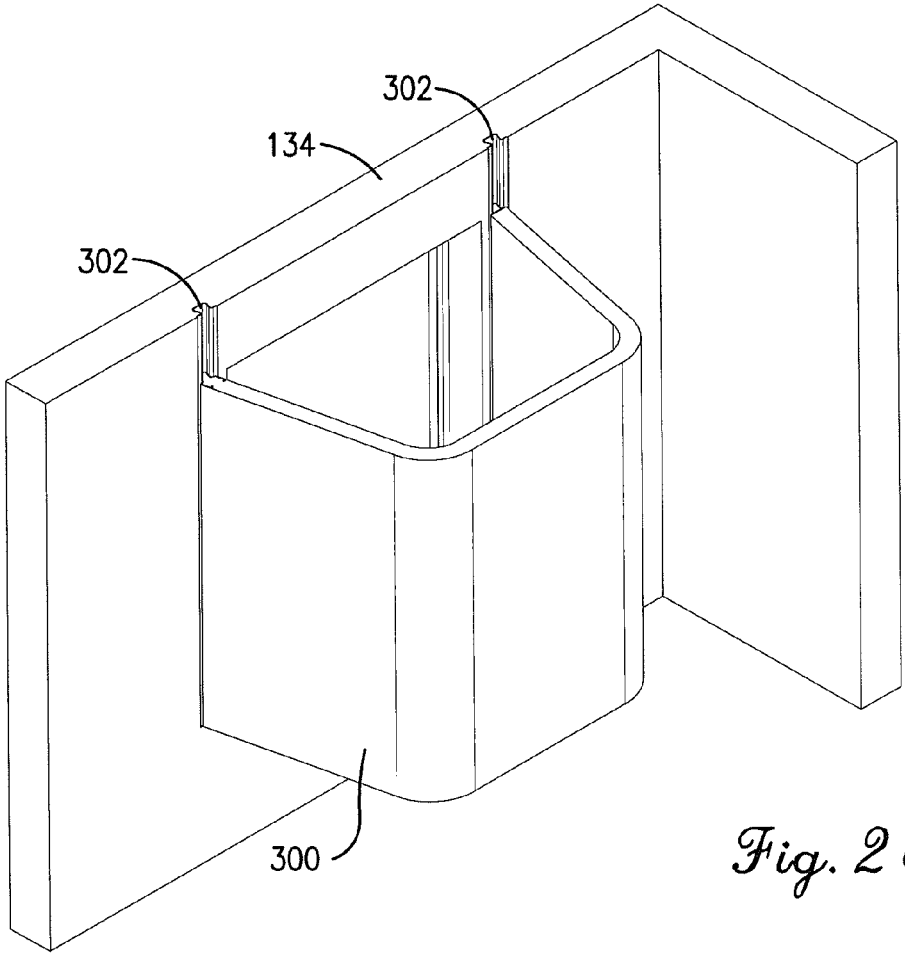
FIG. 26 is a perspective view of a further embodiment of the present invention showing a poured in place window well capable of limited vertical movement relative to a wall to which it is attached by a guide.

In greater detail, the forming panel modules 108 and 110 include pairs of angular sections provided as preferably metal forms, and most preferably of a lightweight relatively inexpensive but relatively rigid material such as aluminum. The forming panel module 108 is comprised of angular sections 112 and 116, and the optional base plate 126, while the forming panel module 110 is comprised of angular sections 114 and 118 and a corresponding optional base plate 126. The optional base plate 126 may also be attached to the top rail of the angular sections by pins and wedges to limit overflow of concrete when design conditions dictate. The angular sections 112 and 116 are configured as inner sections, and thus are shorter in total length than their respective outer sections 114 and 118, so that while the inner sections parallel the outer sections, they are not congruent therewith. The inner sections 112 and 116 are complementally configured to their respective outer sections 114 and 118, so that with the exception of the formation of steps as described hereinafter, the distance therebetween remains substantially constant. Each of the angular sections 112, 114, 116 and 118 has a frame 136 to which a face plate 138 is attached by welding or the like. The face plate 138 has an inner (that is, facing toward the channel 174) concrete receiving surface 140 and an outer surface 142. The concrete-receiving surface 140 may be either substantially smooth, or provided with relief such as a textured relief to present a stucco appearance, a brick-face pattern as shown in FIG. 25, or other impression to the concrete poured thereagainst. The frame 136 includes upper and lower rails 144 and 146 as well as an inboard side rail 148 and an outboard side rail 150, as well as spaced-apart rearwardly extending reinforcing ribs 152 extending from one side rail to the other and which help maintain the shape of the section. The rails 144, 146, 148 and 150 each include a plurality of holes 154 for permitting the sections to be mounted to adjacent forming panels by the use of pins 276 and wedges 278, clamps, or other locking hardware.

The rails 144, 146, 148 and 158 of each section 112, 114, 116 and 118 extend rearwardly from the face plate 138 of each section. The face plate is preferably a continuous sheet of metal and thus bends at a corner 156 of each section. In order to provide the necessary depth of an outboard wall portion 158 of the window well wall 106 away from the foundation wall 134 and to have the outboard wall portion 158 relatively parallel to the portion of the foundation wall 134 opposite, each section 112, 114, 116 and 118 preferably includes an inboard leg 162 which is preferably, though not necessarily straight, and an outboard leg 164 which is preferably, though again not necessarily straight, with the corner 156 therebetween. The corner 156 is most preferably arcuate to minimize stress concentrations and to provide a pleasing appearance to the resulting window well 106.

A first foot 166 is provided in each of the inner sections 112 and 116 which extends toward the window opening to be formed, and thus is angled at an angle of 90 degrees or less relative to the inboard leg 162 from which it extends. More preferably, the inner angle between the first foot 166 and the inboard leg 162 of the inner sections 112 and 116 is between about 85 and 40 degrees, and most preferably about 92½ degrees. Because the rails are preferably constructed approximately perpendicular to the face plate, the inboard side rail 148 preferably is about parallel to the end rail 168 of the exterior wall surface forming panel 170 to which it connects, and as a result, the inboard leg 162 of each of the inner sections 112 and 116 extends outwardly from the forming panels 170 for the foundation wall and converge towards each other and the window opening 172. So that the outboard leg 164 may be approximately parallel to the face plate of the exterior wall surface forming panels 170, as a consequence the preferred angle between the inboard leg 162 and the first foot is the remainder after the inner angle of the corner 156 is subtracted from 180. Thus, in the most preferred embodiment, the angle between the first foot 166 and the inboard leg 162 is 92½ degrees.

The outer sections 114 and 118 also have an inboard leg 162 and an outboard leg 164, and are configured with a corner 156. The outer sections 114 and 118 are constructed to have their corners and inboard and outboard legs substantially parallel but spaced apart from the respective opposing inboard sections 112 and 116. The nominal spacing, and thus the channel 174 between the inboard and outboard sections, is about 3 inches, but may be increased as described hereinafter. In order that the inboard leg 162 of the sections 114 and 118 may connect with adjacent forming panels 170 which are in parallel alignment along the forming wall, a second foot 176 extends from the inboard leg 162 of the outer sections 114 and 118 at least perpendicular or greater, or more preferably at an obtuse angle. Thus, the angle between the inboard leg 162 and the second foot 176 is preferably about 95 to 130 degrees, and most preferably about 102½ degrees. The corners 156 of the outer sections 114 and 118 are arcuate and the angle between the inboard and outboard legs is the same as corners 156 of the inner sections 112 and 116, although the radius of curvature is greater to accommodate the channel 174 into which concrete flows during pouring.

Figure 7:
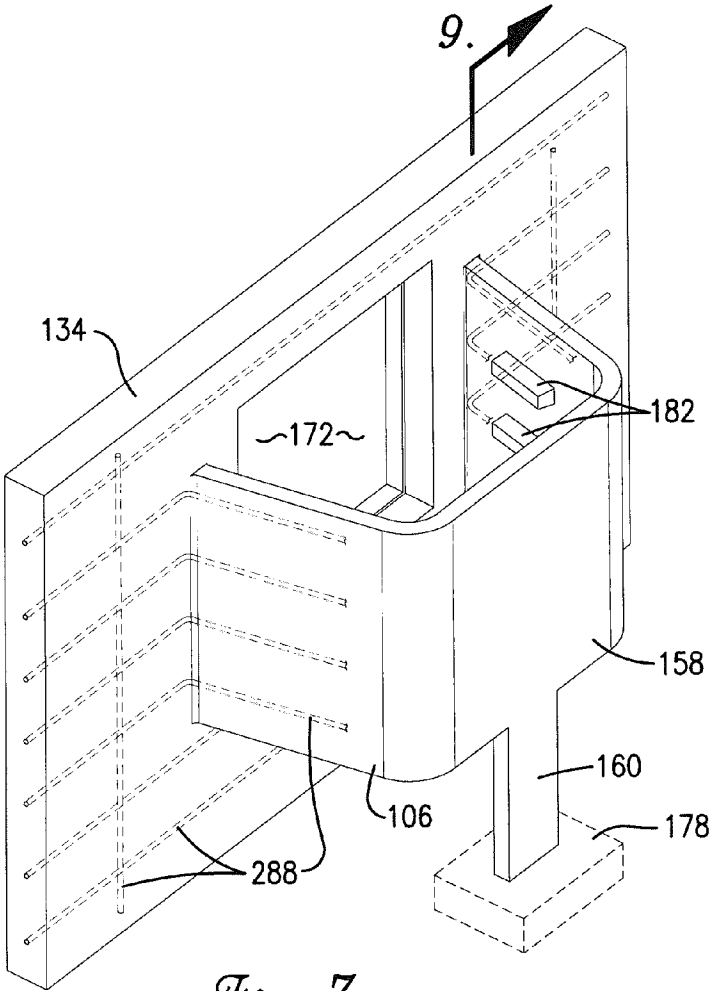
FIG. 7 is a perspective view of the foundation wall with a window and poured-in-place window well in accordance with the present invention taken from the outside of the foundation wall, showing a footing for the pier of the window well in phantom lines.
Figure 10:
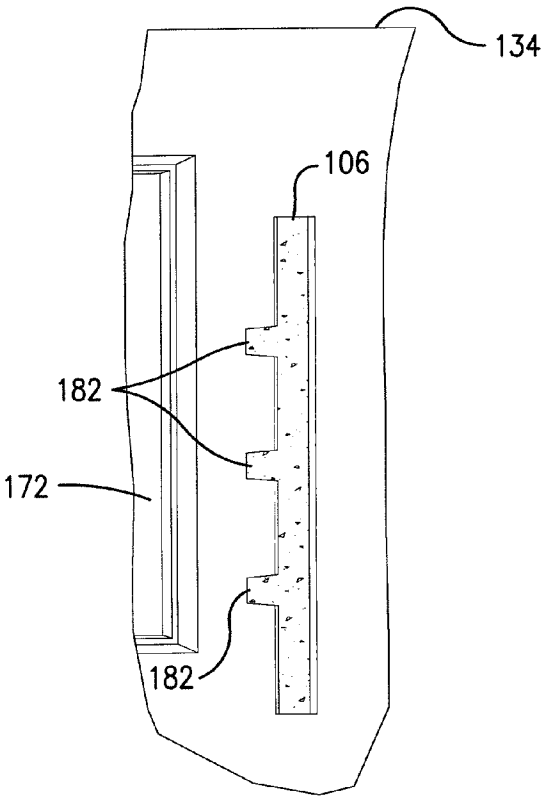
FIG. 10 is a fragmentary vertical cross-sectional view of the foundation wall taken along line 9-9 of FIG. 9 to show the steps formed in the window well wall.
Figure 9:
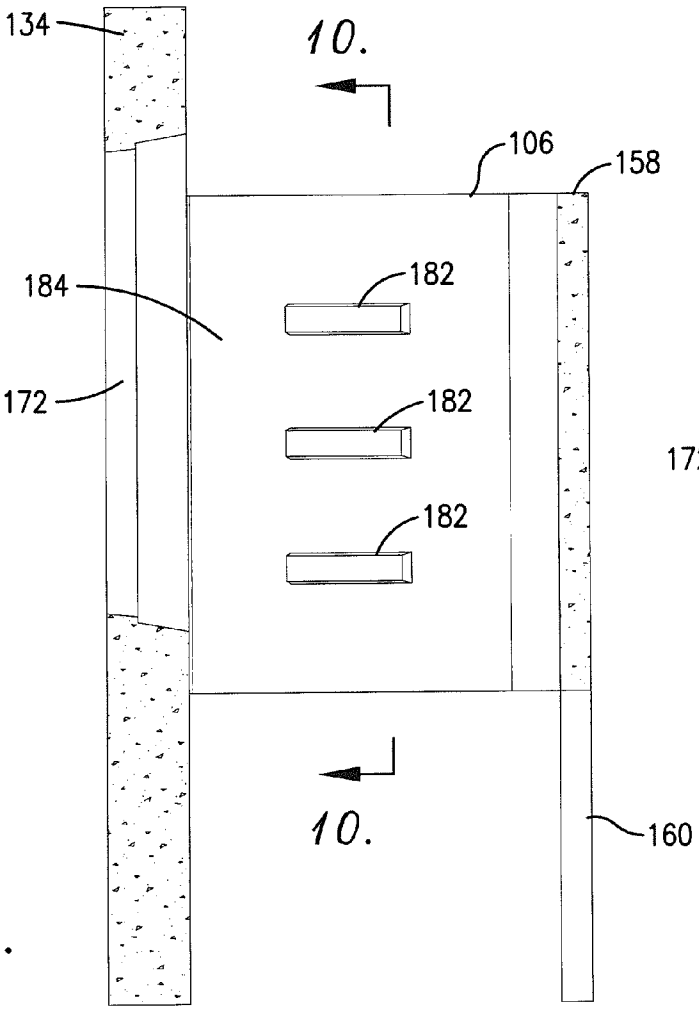
FIG. 9 is a vertical cross-sectional view of the foundation wall taken through line 9-9 of FIG. 7 to show the pier and position of the window well formed in accordance with the present invention in relation to the window opening and foundation wall.
Figure 12:
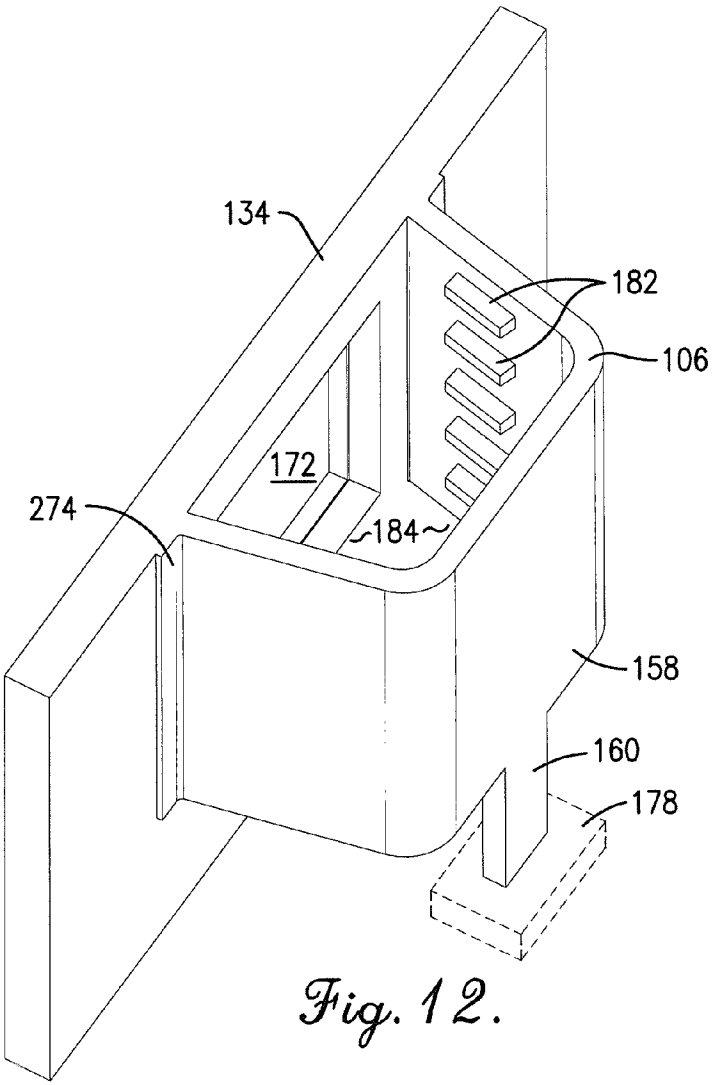
FIG. 12 is a perspective view of the window well and structural wall for a window formed by the forming system of FIG. 11 taken from the outside of the foundation wall.

Outboard side rail 150 of each of the inner sections 112 and 116 may be coupled to the spacer panel 120 and outer sections 114 and 118 may be coupled to spacer panel 122. The spacer panels 120 and 122 are opposed to one another and connected by pins and wedges or other fasteners known to those in the art to filler panels 124 on the lower part of the spacer panels 120 and 122 to constrain the flow of concrete poured therein. The filler panels 124 may be, for example, bulkhead forms or wooden boards used to span the space between the spacer panels 120 and 122 below the forming panel modules 108 and 110 The spacer panels 120 and 122 are opposed to one another and provide several functions and benefits. These include the ability to increase the width of the window well 184 to accommodate windows of various sizes or simply to provide the ability to adjust the width of the window well wall as desired. In this regard, the spacer panels 120 and 122 may be conventional flat forming panels of any desired width having top, bottom and side rails and reinforcing members typically known in the art as "hats" on the rearward, non-concrete-receiving side of a face plate as is conventional. Furthermore, the invention hereof facilitates the use of several such spacer panels 120 and 122 in side-by side relationship to further increase the width of the window well wall 106. Another function and benefit is that spacer panels 120 and 122 may be of different sizes or the same size. For example, the thickness of the concrete in at least a part of the window well wall 106 may be increased by the use of a spacer panel 122 connected to the outer sections 114 and 118 which is wider than spacer panel 120 which is connected to the inner sections 112 and 116. A further function and benefit when needed is to provide a support for the window well wall 106 by providing a space for receipt of concrete to form a pier 160 which supports the window well wall 106 so that the wall 106 is not cantilevered from the foundation wall but without the necessity of extending the modules 108 and 110 downwardly so that the entire window well wall 106 extends downwardly as far as the lower edge of the adjacent foundation wall. As shown in FIGS. 7 and 12, a footing 178 of concrete is typically poured in an excavation for the window well and the spacer panels 120 and 122 are placed thereon and enclosed by the filler panel 124 to enclose and limit the volume of the pier to be poured on the footing and between the spacer panels.

As may be seen from the drawing FIGS. 1, 2, 3, 6 and 11, the inner sections 112 and 116 are in fact constructed substantially identically in the preferred embodiment. Because each has both upper and lower rails 144 and 146 with mounting holes provided thereon, it is only necessary to invert an inner section 112 in order to use it as the opposite inner section 116. The same is true with regard to the outer sections 114 and 118 which are substantially identical in construction—by inverting the outer section 114, it can be used as the opposite outer section 118. Of course, it is to be understood that the inner sections 112 and 116 are differently sized, although complemental for use with the outer sections 114 and 118, this ability to interchangeably use the inner sections by inverting them, and also to invert and interchange the outer sections, greatly simplifies replacement and inventory control, and reduces costs.

In order to enclose the bottom of the modules 108 and 110, base plates 126 are provided which conform in shape to the forming panel modules and include holes 180 for alignment with the holes 154 in the upper or lower rails of the modules. Fasteners such as pins and wedges or clamps may be used to couple the base plates to the respective sections of the modules 108 and 110 and to thereby inhibit the escape of flowable concrete through the bottom of the window well forming panel system 100. Typically, if the upper rails of the modules 108 and 110 are no lower than about a foot below the top of the pour into the forming panels 170 or further cap forms or other forms coupled thereabove, the hydraulic effect is insufficient to cause the concrete to flow up and over the upper rail 144 of the forming modules 108 and 110 and thus it is not necessary to cover the forming modules. However, where the height of the top of the foundation wall 134 is greater than about one foot above the top of the upper rail 144 of the forming modules 108 and 110, then additional base plates 126 may be attached to the upper rails using fasteners or clamps as described above to inhibit the overflow of concrete.

Figure 4:
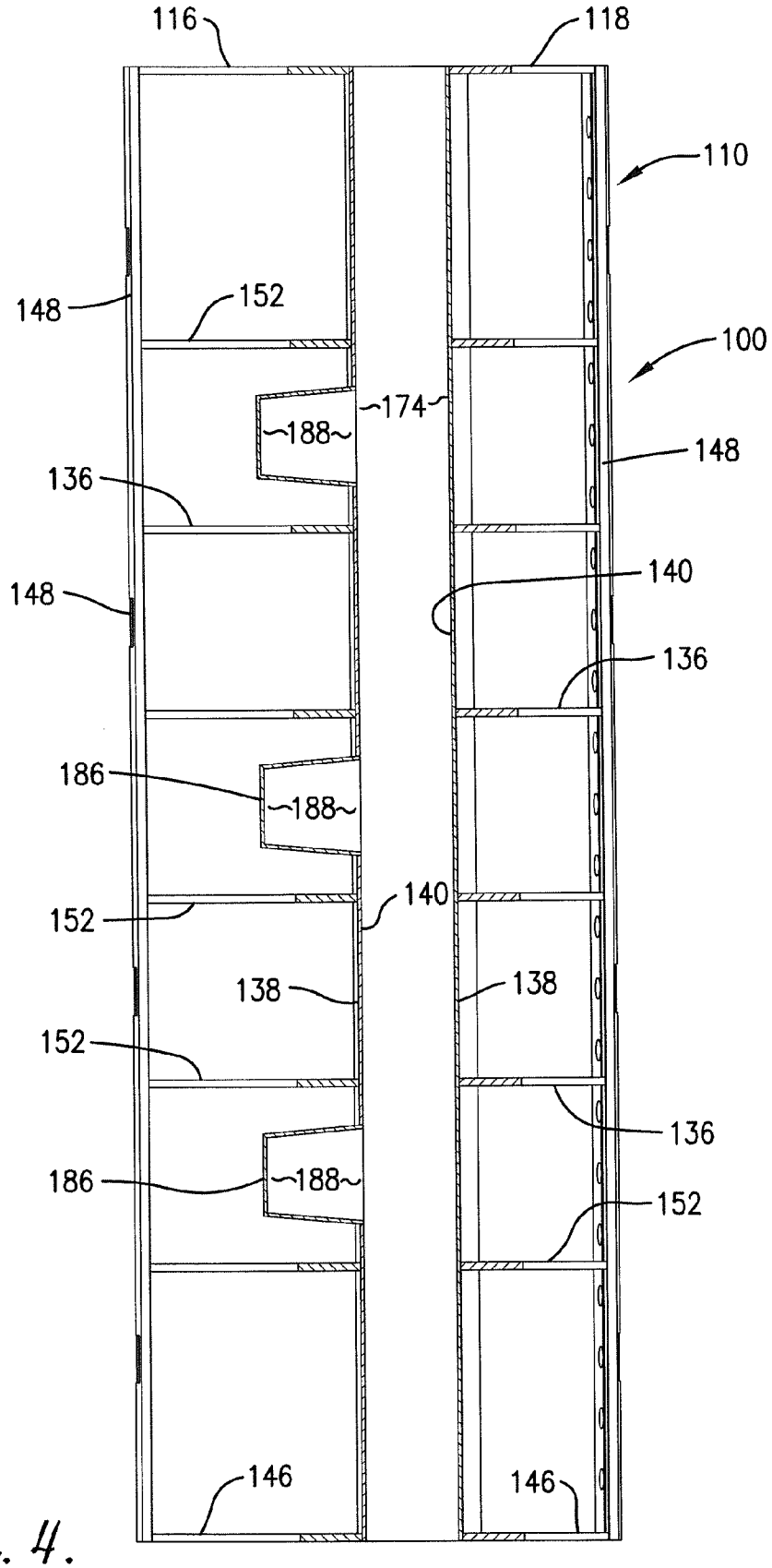
FIG. 4 is an enlarged vertical cross-sectional view of two opposed angular members of a forming panel module taken along line 4-4 of FIG. 3 to show the structure for forming poured-in-place steps in the window well.
Figure 5:
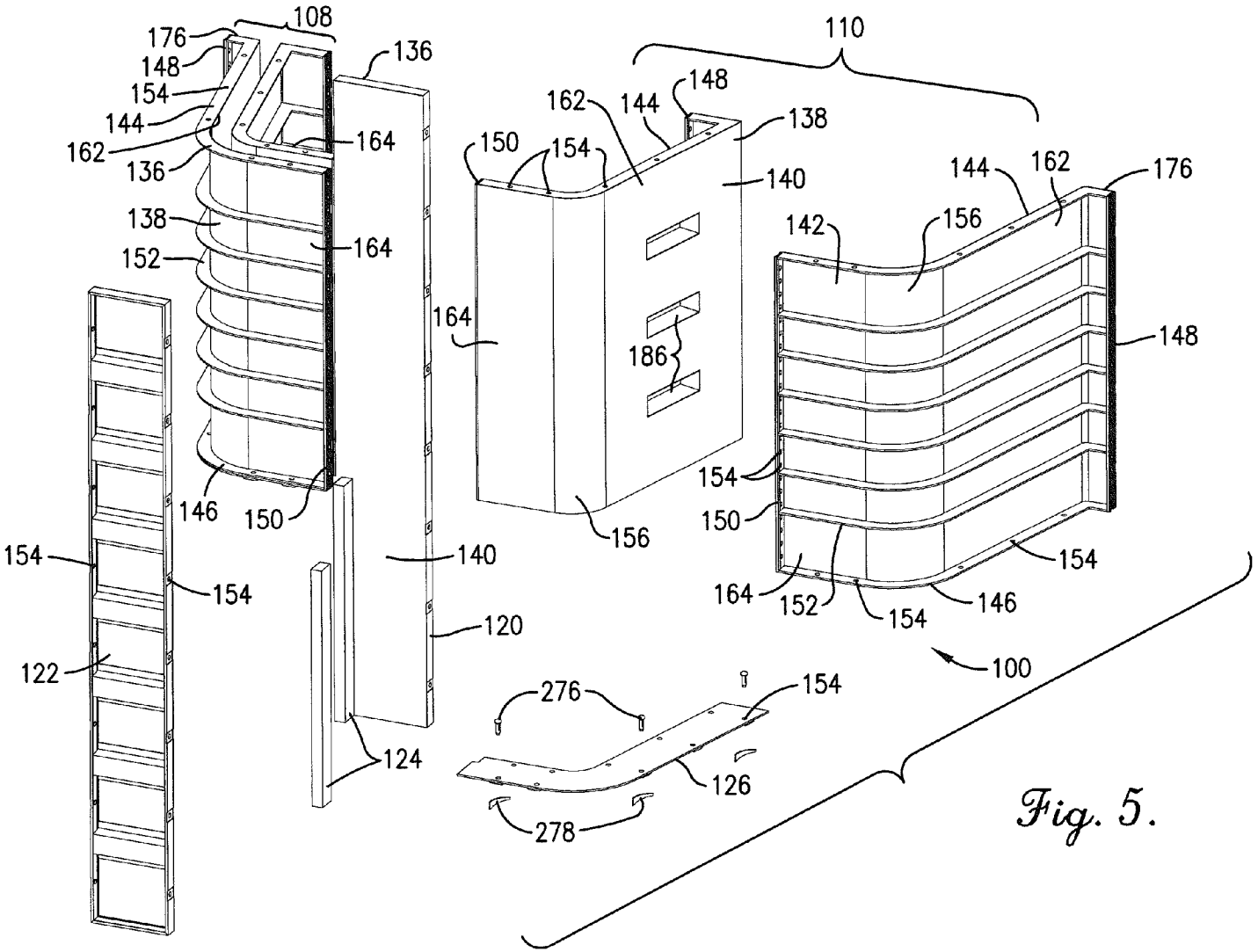
FIG. 5 is a partially exploded perspective view of the apparatus hereof taken from the outside of the window well form, showing the forming panel modules, the spacer forms, fillers for inhibiting leakage from the bottom of the spacer forms, and one of the base plates for closing the bottom of the forming panel modules.
Figure 6:
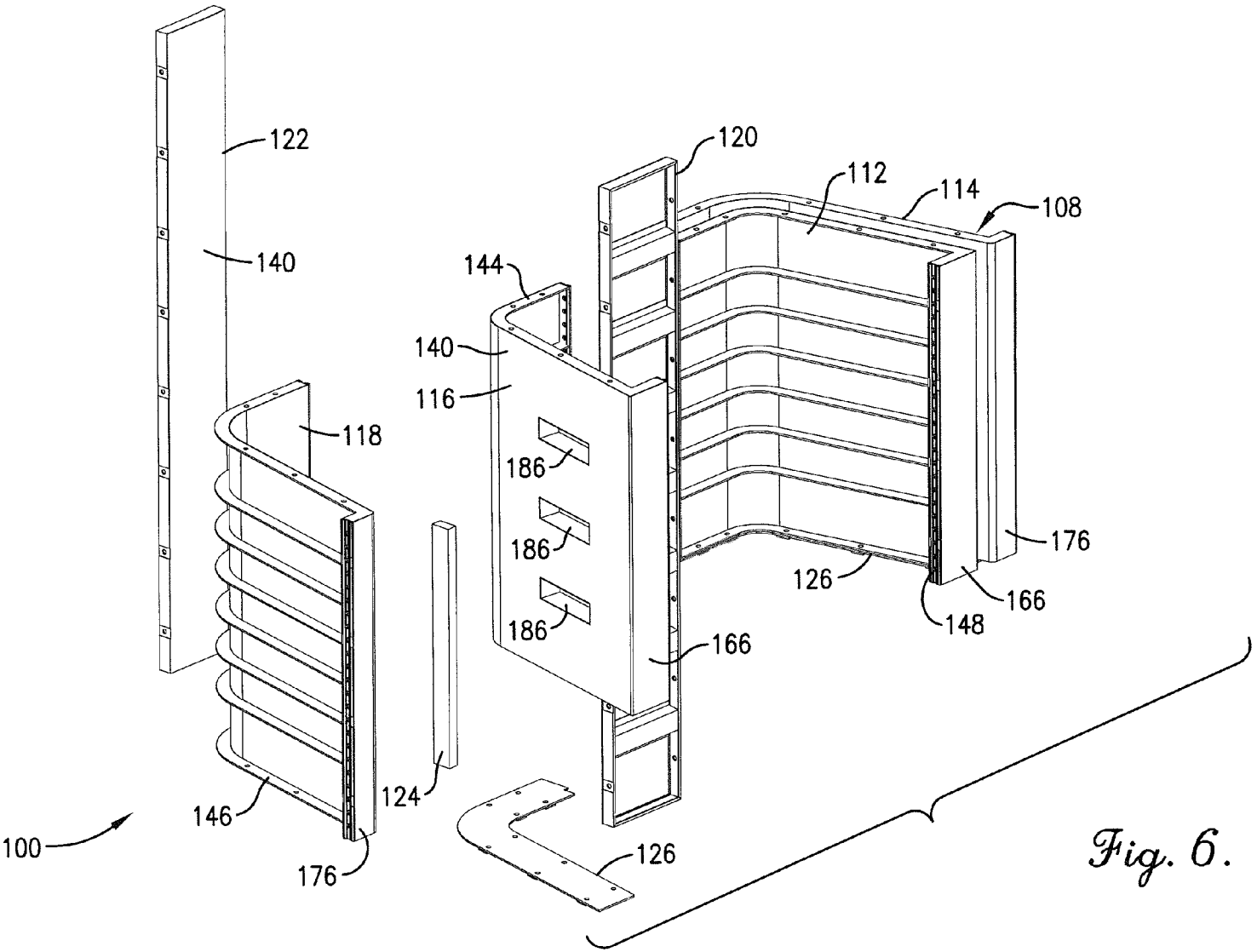
FIG. 6 is a partially exploded perspective view of the window well form taken from the inner or window side of the forming system.
Figure 8:
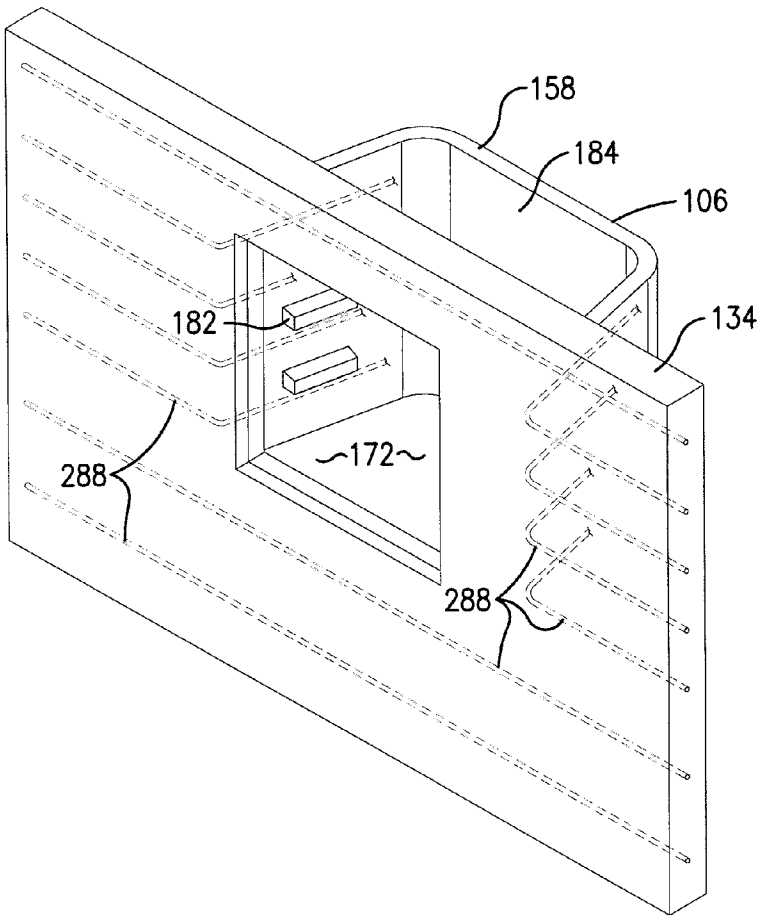
FIG. 8 is a perspective view of the foundation wall of FIG. 7 taken from the inside of the structure.
Figure 11:
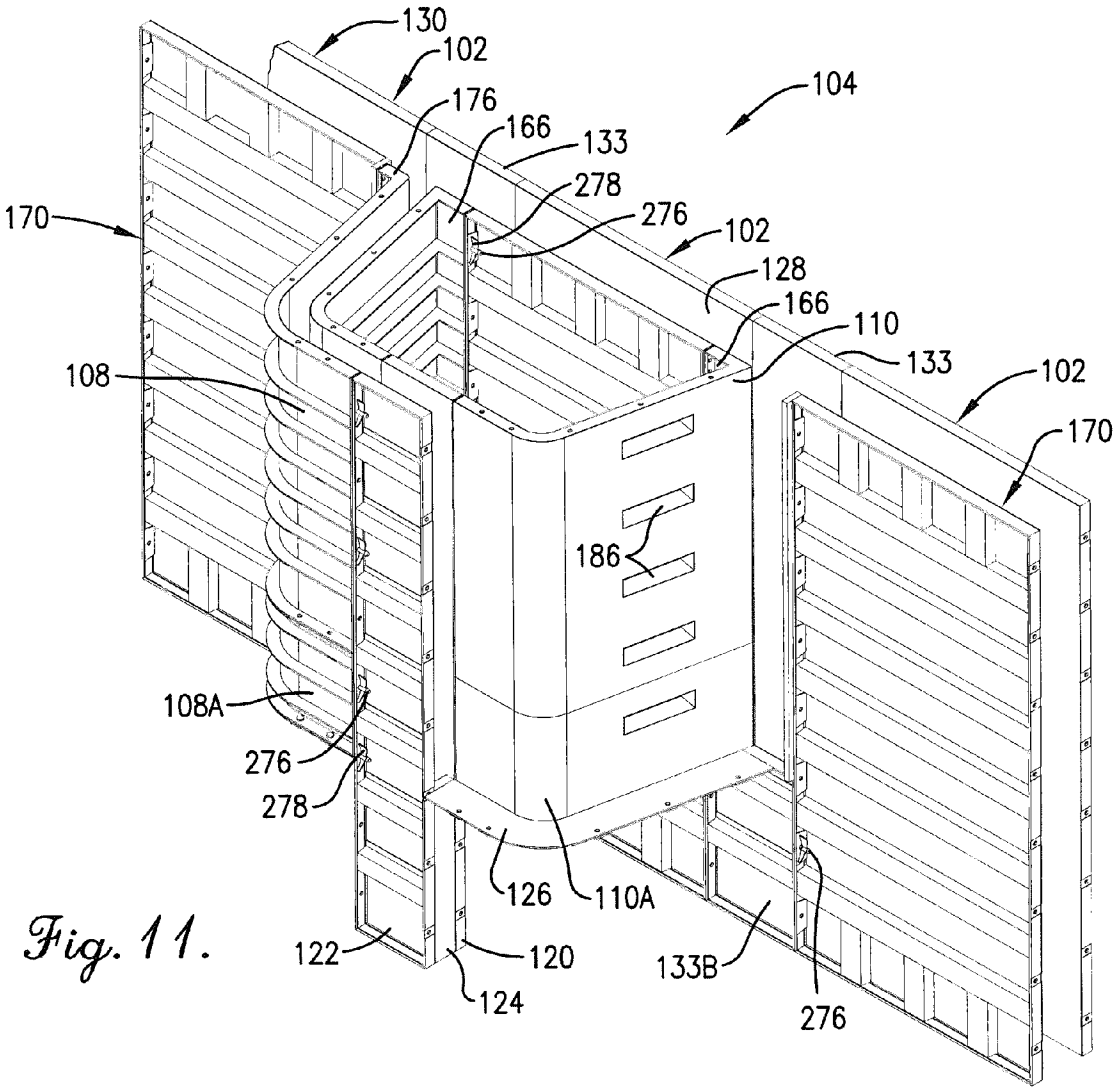
FIG. 11 is a perspective view of a forming system similar to FIG. 1, but with one of the angular sections removed for clarity, and showing the vertical stacking of window well forming panel modules to increase the height of the window well wall and the use of a filler section at the connection between an outer angular section and a flat forming panel to increase the thickness of the window well wall.

FIGS. 3, 4, 5 and 6, and also FIG. 11 show how one of the inner sections 112 or 116 may be configured to provide steps 182 for a cast-in-place window well wall 106 for facilitating egress from the window well 184 between the foundation wall 134 and the window well wall 106. In FIGS. 3, 4, 5 and 6, the face plate of the inner section 112 is configured with a plurality of vertically aligned, laterally elongated boxes 186 extending from the rear of the face plate into the interior of the window well 184 to be formed. The boxes 186 are generally slightly tapered on their lateral sides and top and bottom as seen in FIG. 4 and evidenced by FIGS. 7, 8, 9 and 10 to facilitate removal of the inner section 112 or 116 including such boxes from the cured or curing concrete, and define recesses 188 of a corresponding shape and into which concrete flows during pouring. As a result, upon removal of the modules, steps 182 are formed in the shape of the recesses, and extend inwardly toward the window well. While shown with respect to inner section 112, it is to be understood that such boxes 186 can also be provided in the spacer panel 120 for a central location of the steps, and on either inner section 112 or 116. In this regard, FIG. 11 shows the placement of the boxes 186 in an inner section 116 so that the steps 182 thus formed and shown in FIGS. 12, 13, 14 and 15 are on the opposite interior side of the window well wall than those shown in FIGS. 7 and 8. The resulting steps are slightly tapered and project inwardly from the window well wall 106 a short distance, e.g. about 3 inches, to provide a foothold for egress.

Figure 16:
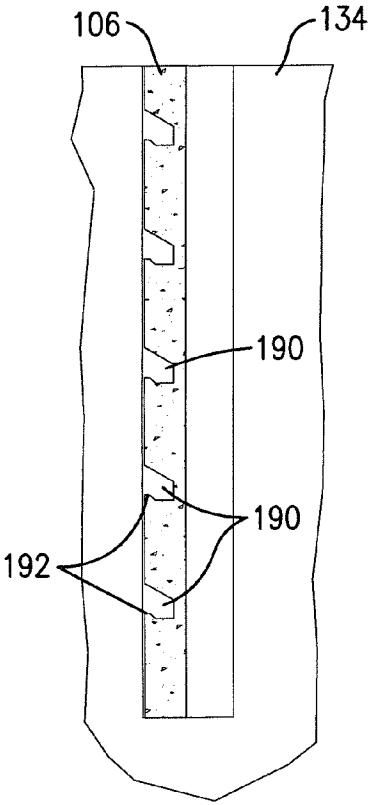
FIG. 16 is a fragmentary vertical cross-sectional view of an alternate foundation wall formed in accordance with the invention using an angular section including projections for forming steps into the window well wall.
Figure 15:
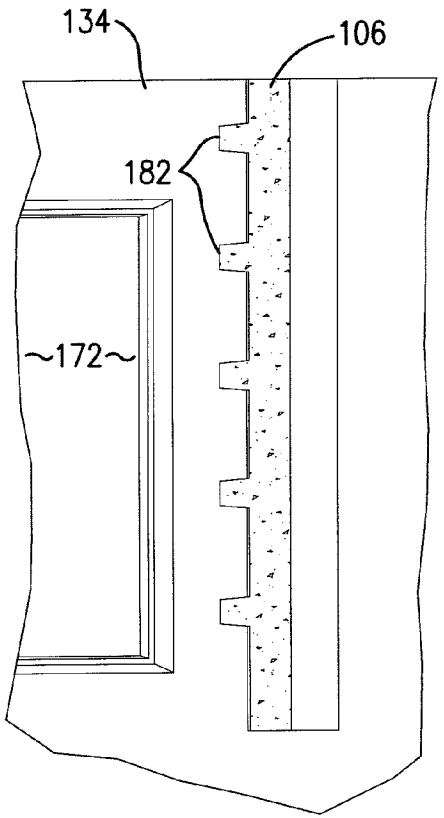
FIG. 15 is a fragmentary vertical cross-sectional view of the foundation wall and window well wall taken along line 15-15 of FIG. 14.

Alternatively, the inner sections 112 or 116, or the spacer panel 120, may be configured with a box extending in the opposite direction, that is, forwardly into the channel where the concrete is received between the inner sections and outer sections of the forming modules. As shown in FIG. 16, steps 190 are provided which extend into the window well wall 106 by such construction. To provide such steps having a small upwardly projecting lip 192, it may be beneficial to use a flexible form member of synthetic rubber or the like placed over the face plate of the inner section 112 or 116, so that the forming member may be more easily removed without damaging the window well wall. Alternatively, such lips 192 may not be desirable in all applications, wherein the boxes will mirror the outwardly projecting boxes 186 described above.

Figure 2:
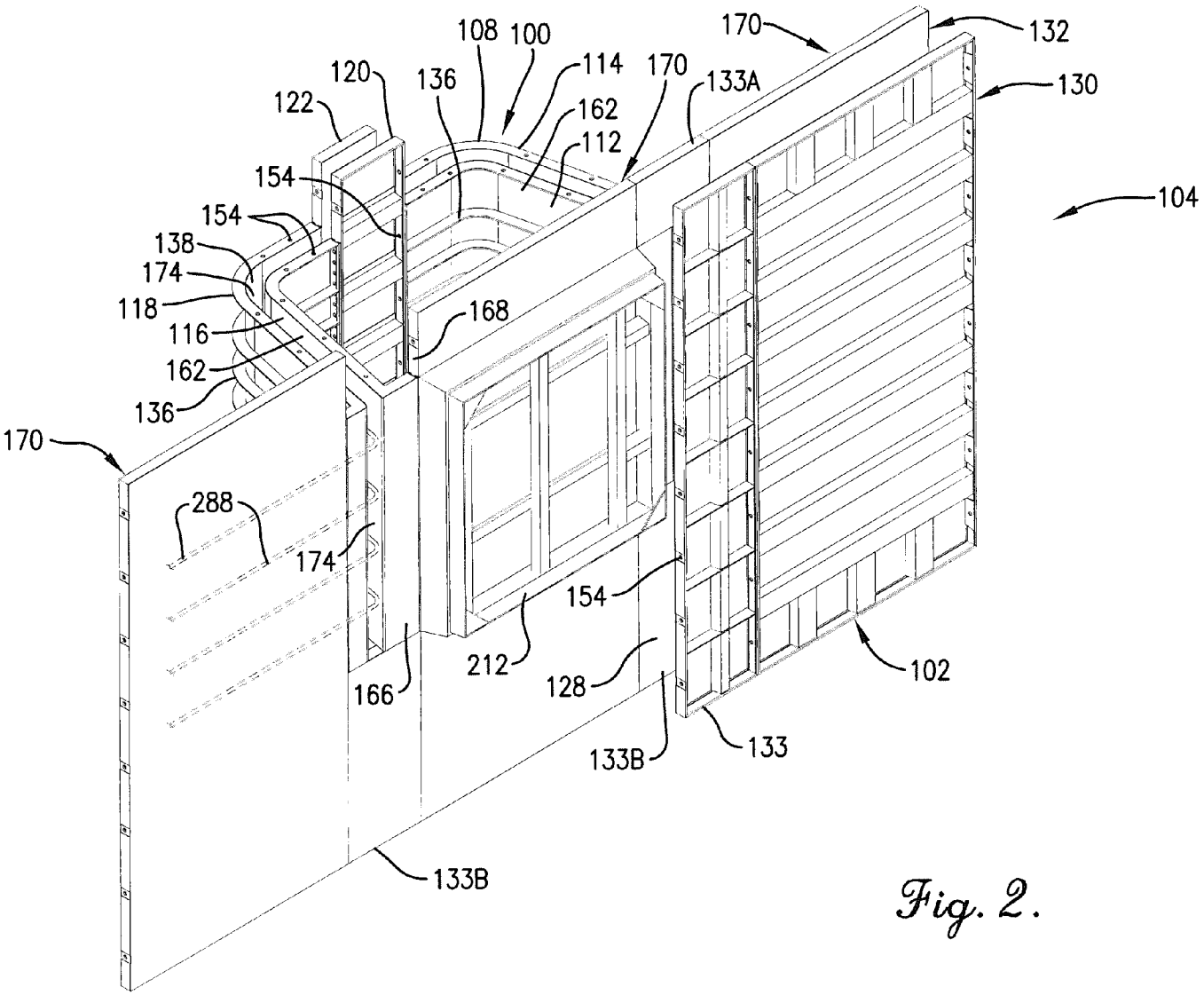
FIG. 2 is a perspective view of the forming system of FIG. 1 from the upper interior side of the forming wall system, showing the placement of some reinforcing members in dashed lines with some of the forming panels removed for clarity to show a window buck in position for forming a window opening in a foundation wall.
Figure 3:
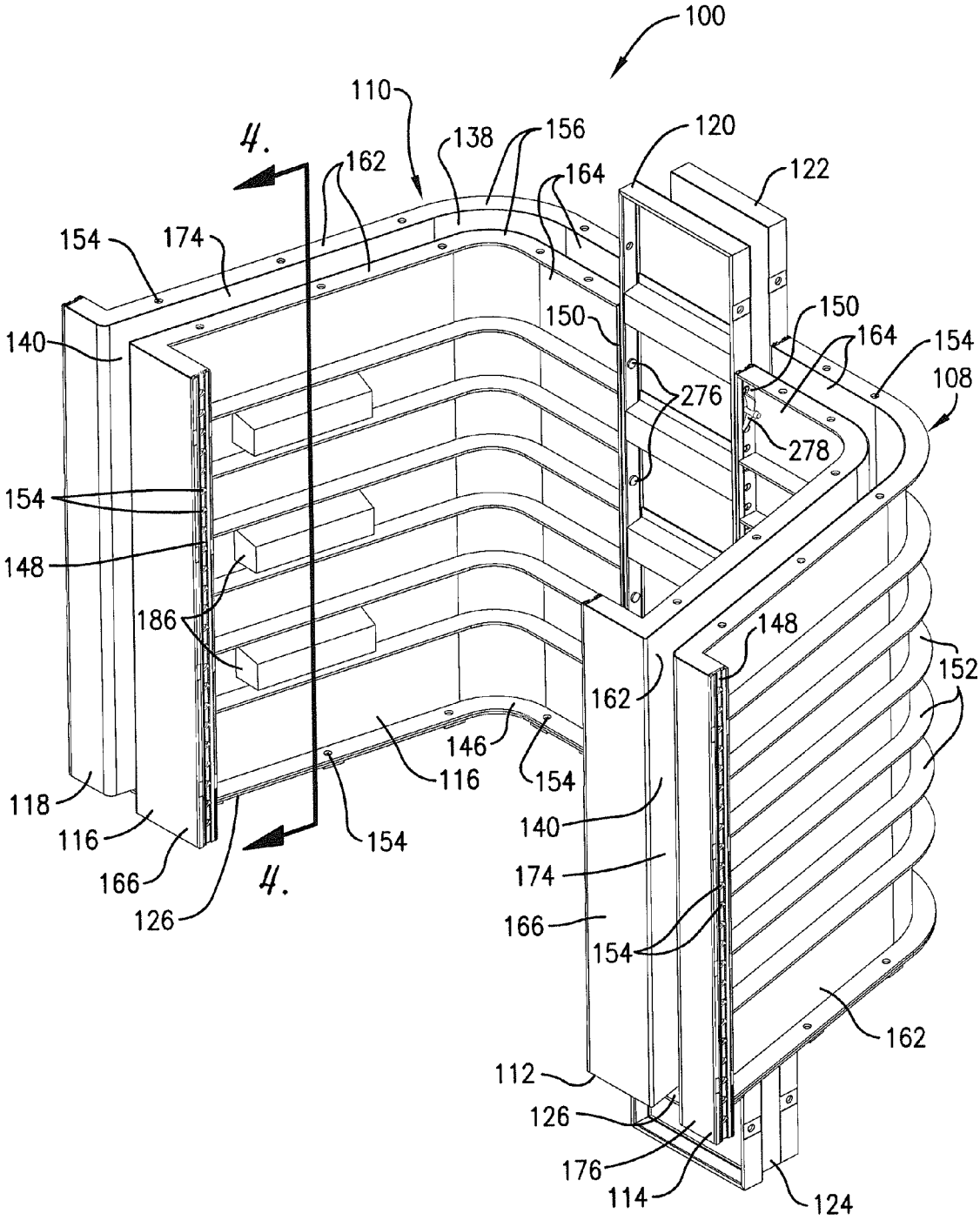
FIG. 3 is an enlarged upper perspective view of the forming panel modules and a spacer form for forming a pier at the outboard portion of the window well taken from the inner or window well side of the forming panel modules, with one of the forming panel modules including recesses in the face panel for forming steps.
Figure 17:
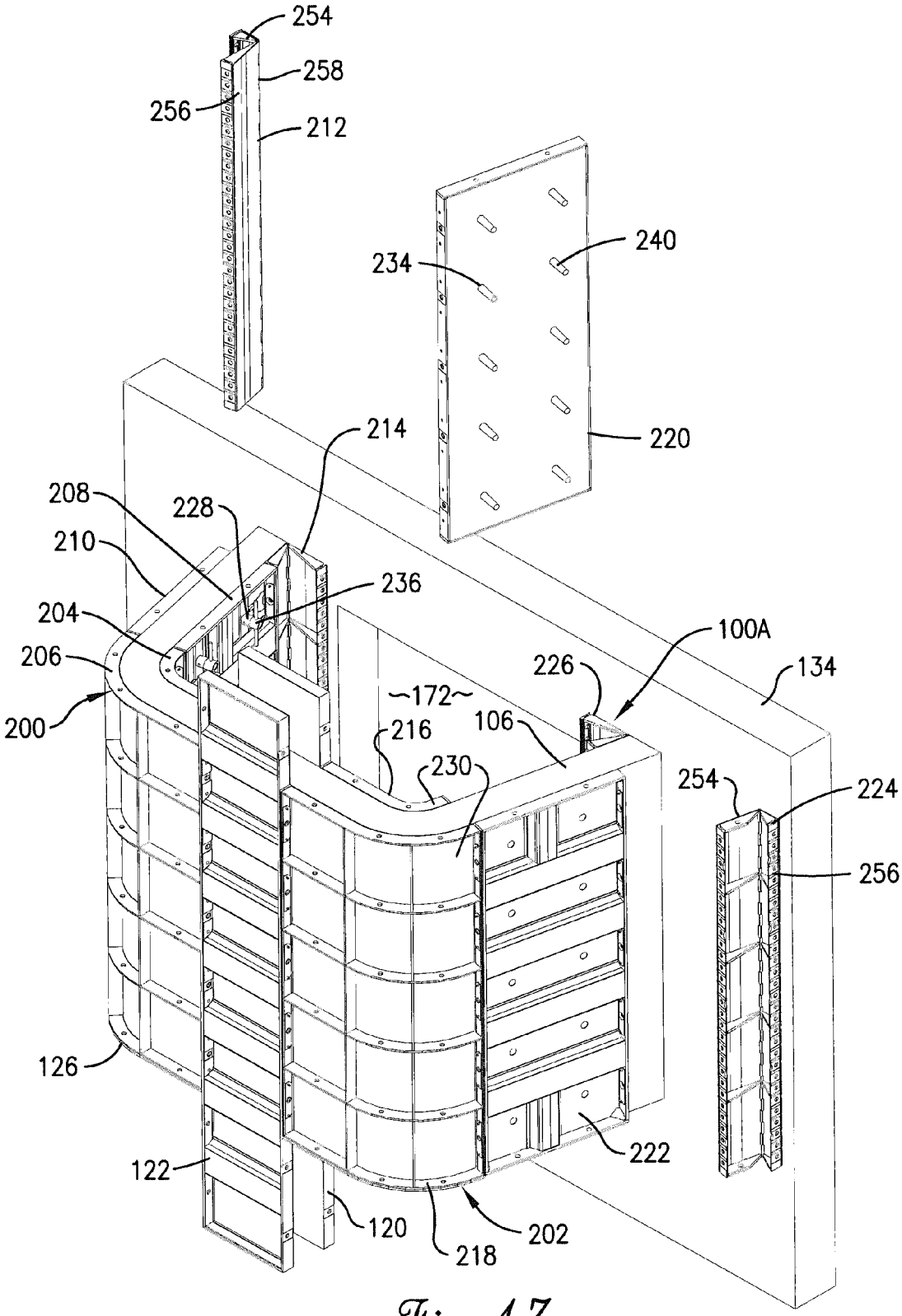
FIG. 17 is an exploded perspective view of an alternate forming system in accordance with the present invention, which includes hinged foot members on the inboard portions of the modules for coupling to the forming panels of the building wall and forming panels having bushings which receive tapered tools for forming step-receiving hollows in the window well wall.

A further approach to the provision of steps in a cast-in-place window well wall 106 is illustrated in FIGS. 17, 18, 19, 20, 21, 22 and 23. FIG. 17 shows a modified window well forming panel system 100A in accordance with the present invention after the foundation wall 134 and the window well wall 106 have been poured in place and cured to sufficient hardness to be self-sustaining. In FIG. 17, the forming panels 102 and 170 of the forming panel walls 130 and 132, and the window buck 272 as shown in FIG. 2 have been removed for clarity, showing the foundation wall 132 and window opening 172 which remain after the forming panel walls 130 and 132 and the window buck 272 are removed. However, it is to be understood that the forming panels 102 and 170 of the forming panel walls 130 and 132, and the window buck 272, are also used in substantially the same manner as shown in FIG. 2 in conjunction with the modified window well forming panel system 100A. However, the window well forming panel system 100A also includes additional features which provide increased adaptability of use. These include modified forming panel modules 200 and 202. The left side forming panel module 200 includes an angular inner section 204, an angular outer section 206, inside window well wall forming panel 208, outside window well forming panel 210, outer hinged foot 212 and inner hinged foot 214, as well as optional base plates 126 configured to couple to the bottom rails of the respective components of the module 200 components described above using pins and wedges as is convention and to thereby extend across the concrete receiving channel 174 adjacent the bottom rails to inhibit the escape of concrete from the bottom of the channel when the bottom rails are not resting on the ground or on footings previously poured on the ground. Similarly, the right side forming panel module 202 includes angular inner section 216, angular outer section 218, inside window well forming panel 220, outside window well forming panel 222, outer hinged foot 224 and inner hinged foot 226, as well as optional base plates 126 configured to couple to the bottom rails of the respective components of the module 202 components described above using pins and wedges as is convention and to thereby extend across the concrete receiving channel 174 adjacent the bottom rails to inhibit the escape of concrete from the bottom of the channel when the bottom rails are not resting on the ground or on footings previously poured on the ground. As with the respective sections 112, 114, 116 and 118 of the modules 108 and 110 are of the same construction and configuration, the inner sections 204 and 216 are of the same construction and configuration, the outer sections 206 and 218 are of the same construction and configuration, the inside window well forming panels 208 and 220, the outside window well forming panels 210 and 222 are of the same construction and configuration, the outer hinged feed 212 and 224 are of the same construction and configuration, and the inner hinged feet 214 and 226 are of the same construction and configuration, thereby avoiding additional on-site inventory. The sections 204 and 216, as well as sections 206 and 218, have respectively shorter inboard legs 230 compared to the inboard legs 162 of the sections 112, 114, 116 and 118 because the window well forming panels 208, 210, 220 and 222 are provided to give sufficient distance between the spacer panels 120 and 122 and the window opening 172.

Figure 18:
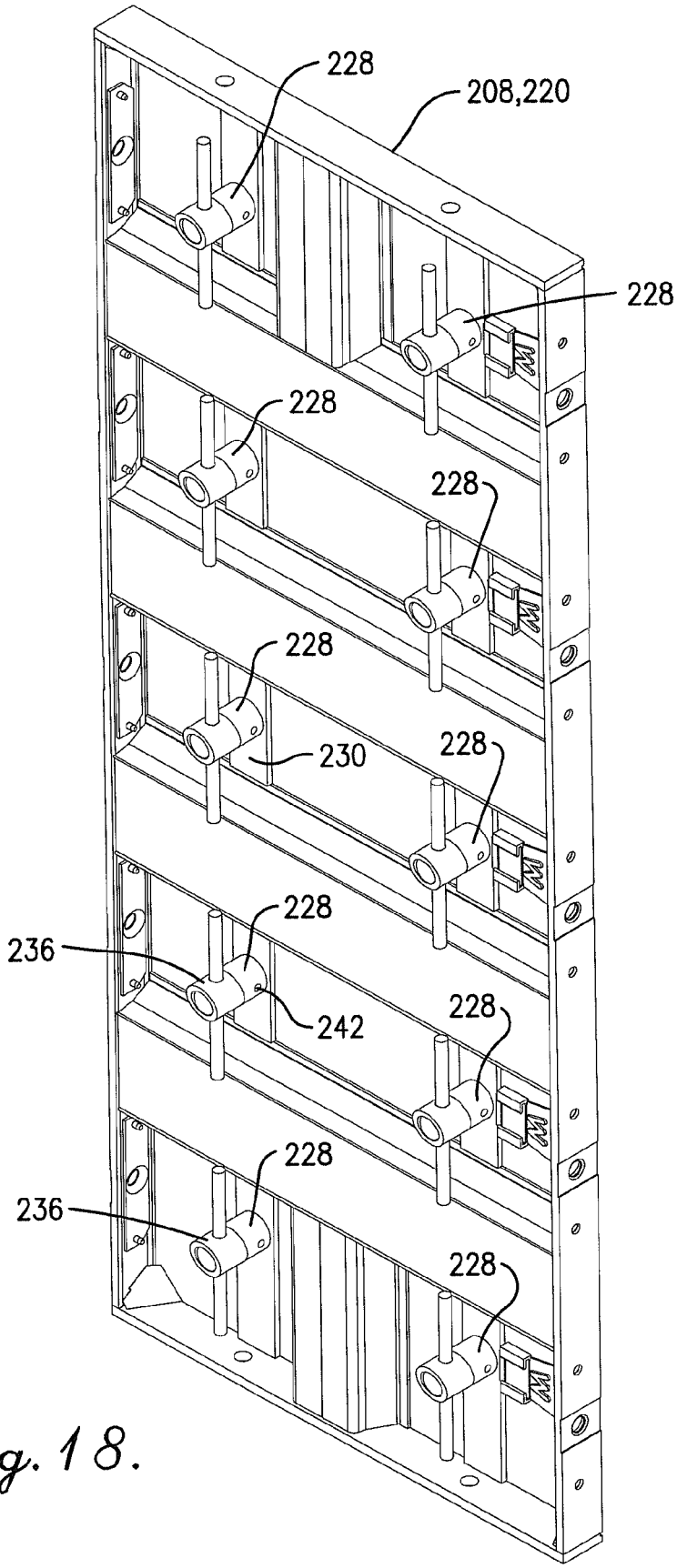
FIG. 18 is an enlarged perspective view of a forming panel having bushings arranged in vertical and horizontal alignment and receiving tapered tools as shown in FIG. 17.
Figures 19, 20, 21:
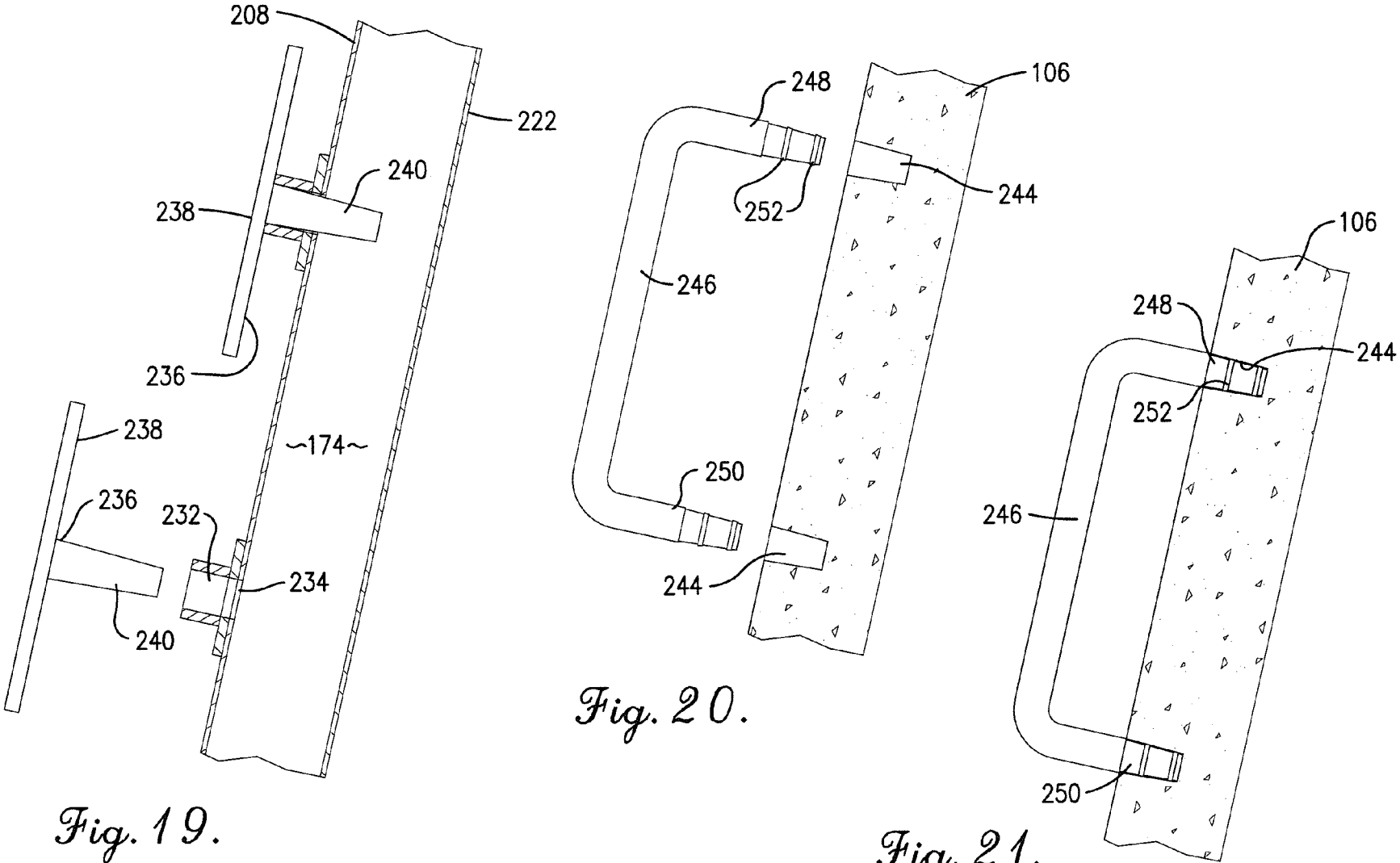
FIG. 19 is an enlarged fragmentary horizontal cross-sectional view of an alternate embodiment of the window well forming panels of FIG. 18 showing the provision of bushings which receive the tapered cone-shaped forming tools for providing cone-shaped hollows in the window well wall which face inwardly into the window well.
FIG. 20 is an enlarged exploded horizontal cross-sectional view of a window well wall formed by the alternate embodiment of FIG. 17, showing the provision of a U-shaped step and cone-shaped hollows in the window well wall for receiving the step.
FIG. 21 is an enlarged horizontal cross-sectional view of the window well wall after insertion of the U-shaped step into the cone-shaped hollows whereby a step is provided for ingress and egress from the window well.

The outside window well forming panels 210 and 222 are of well-known construction including frames of aluminum include rails having holes for receiving coupling pins, and reinforcing members to which a face plate is welded as is known in the art, and are sized to be of a desired height and width. If provided with holes in the face plate thereof, plugs of synthetic rubber may be inserted therein to prevent concrete from flowing therethrough. The inside window well forming panels 208 and 220 are similarly constructed, but additionally include metal, typically steel or alternatively aluminum, bushings 228 welded to reinforcing bars 230 which are on the outer face 142 of the face plate 138 thereof so that the inside window well forming panels serve as step riser forms. The bushings 228 have a central bore 232 which is aligned with holes 234 in the face plate 138 of the panels 208 and 220. The bushings 228 and their corresponding holes 234 are arranged in vertical and horizontal alignment as seen in FIGS. 17 and 18, so that the horizontal distance between horizontal pairs of holes 234 in a row are uniform, and the holes 234 arrayed on the face plate are in two vertically aligned columns. As seen in FIGS. 17, 18 and 19, the bushings 228 and their corresponding holes 234 may receive tools 236 having handles 238 and frustoconically shaped and thus tapered projections 240. The tapered projections 240 are of a length such that when the tools are fully seated in the bushings 228, the projections extend a uniform, partial distance into the channel 174. The tools 236 may be held in place by friction, or by bolts (not shown) which may inserted into threaded holes 242 in the bushings 228 to retain the shanks 240 in position during pouring and curing of concrete received in the channel 174.

Concrete received in the channel 174 flows around the projection to provide a cone-shaped hollow 244. When the concrete in the channel 174 is sufficiently cured to be self-sustaining, thereby forming the window well wall 106, the tools 236 are removed from their respective bushings 228 to leave the corresponding, frustoconically shaped hollows 244. The hollows 244 may also be provided by a drill using a masonry bit. U-shaped steps 246 having spaced apart substantially parallel extending fingers 248 and 250 may then be mounted to the inside (that is, the window well facing side) of the window well wall 106 to provide ingress and egress. The U-shaped steps 246 are preferably of synthetic resin or the like and may be adhesively bonded or more preferably provided with elastomeric ribs 252, nubs or other gripping members to hold fast to the window well wall 106 when pushed or driven into the hollows 244, as seen in FIGS. 20 and 21.

Figure 23:
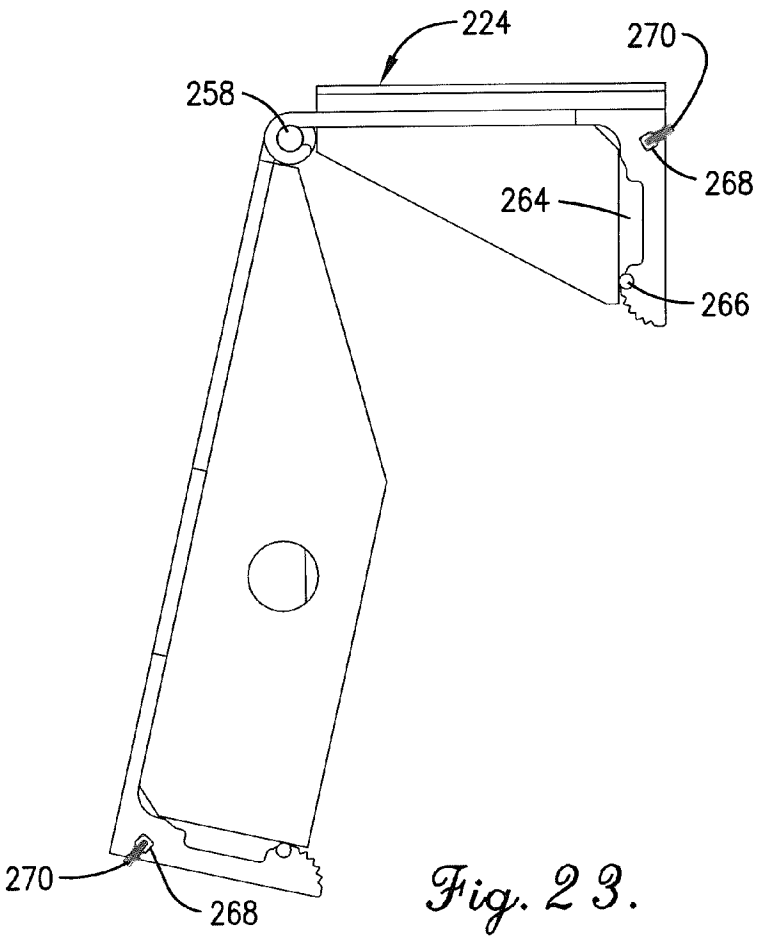
FIG. 23 is an enlarged plan view of one of the hinged feet shown in FIG. 17 having pivotally connected upright panels for attachment to forming panels of the forming panel wall and to an inner section of the window well forming panel system hereof.
Figure 22:
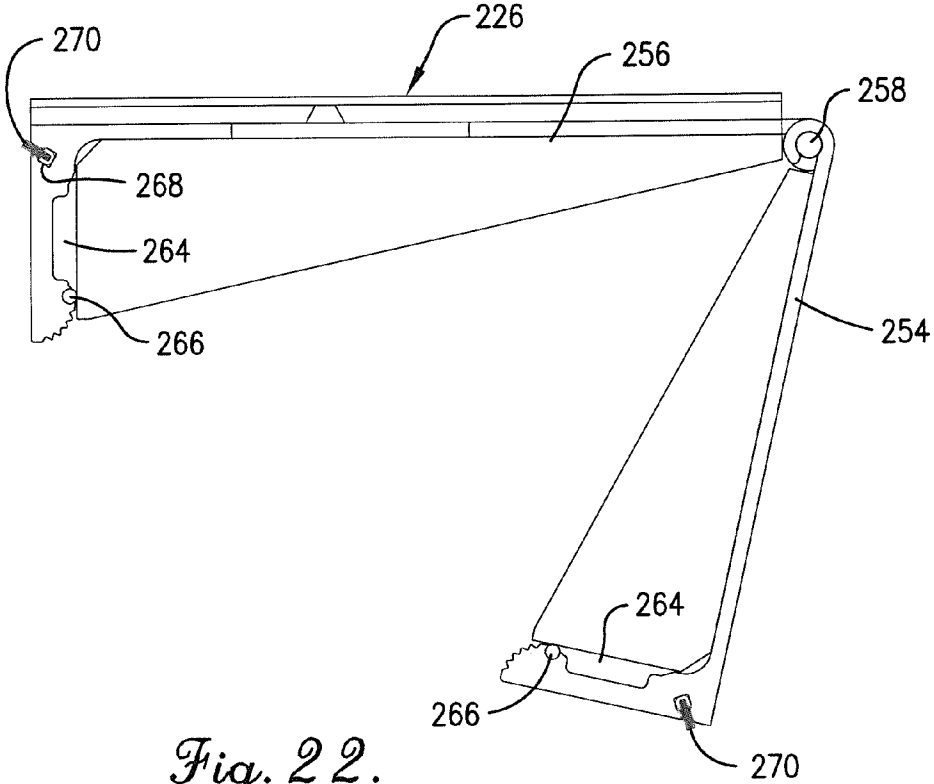
FIG. 22 is an enlarged plan view of one of the hinged feet shown in FIG. 17 having pivotally connected upright panels for attachment to forming panels of the forming panel wall and to an outer section in the window well forming panel system hereof.

In the modified window well forming panel system 100A, it may be also be seen that the feet 212, 214, 226 and 228 are provided as separate members rather than unitary with the inner and outer sections as shown with regard to the forming system 100. The feet 212, 214, 226 and 228 can be of any desired width of vertical length, but in the embodiment illustrated herein, the feet are all of the same length and feet 212 and 226 are of one width while feet 214 and 228 are of a different width. It is simply to be understood that the length of the feet will require corresponding filler panel sections in the forming panel wall 132 above and below the feet, as illustrated in FIG. 1, for example. Each of the feet 212, 214, 226 and 228 include a first upright panel 254 extending toward a respective angular section (and thus away from the forming wall panel 132) pivotally coupled to a second upright panel 256 extending toward the exterior forming wall panels 170 in the same manner as shown in FIGS. 1 and 2 (and thus substantially parallel to the foundation wall 134) preferably by a hinge 258, shown as a barrel hinge as shown in FIGS. 22 and 23. As seen in FIG. 17, the each panel of the feet includes a side rail 260 spaced on the remote portion of the foot from the hinge 258, the side rail 260 including a large number of holes 262 therein to facilitate adjustment and mounting to the adjacent inner or outer forming panels. The portion of the side rail 260 adjacent the holes 262, as with the rails of the frames of the other components of the forming panels systems 100 and 100A, may be provided with plates 264 and reinforcing wires 266 for strengthening and slots 268 which receive flexible barriers 270 which inhibit the passage of fluid concrete therepast.

Figure 13:
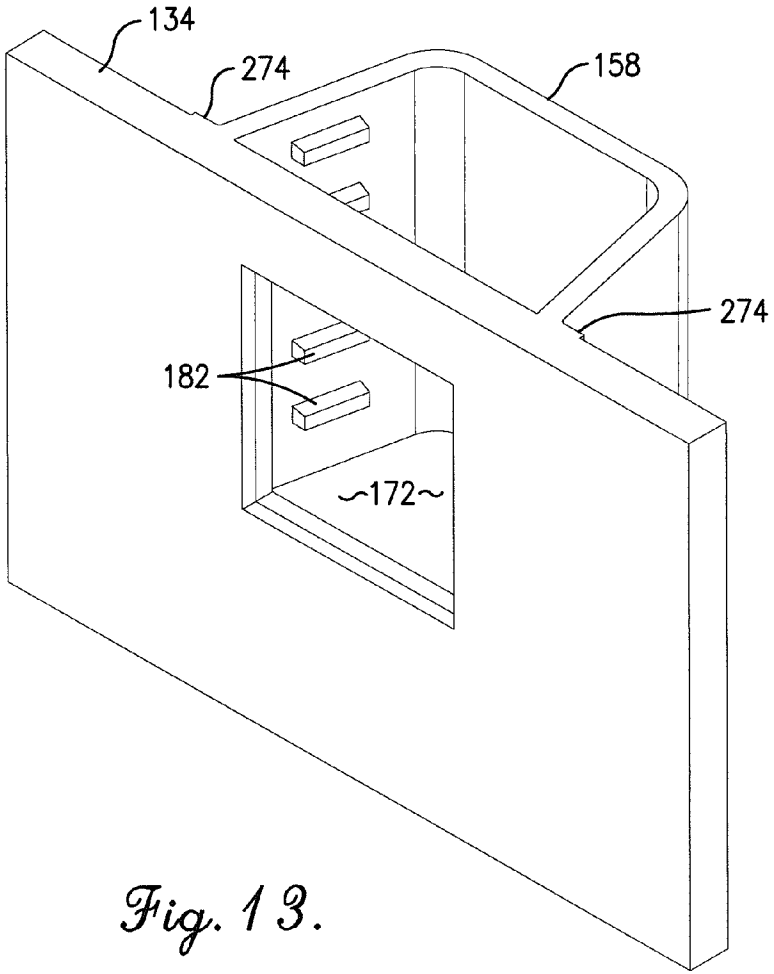
FIG. 13 is a perspective view of the window well and structural wall of FIG. 12 taken from the interior side of the window opening.
Figure 14:
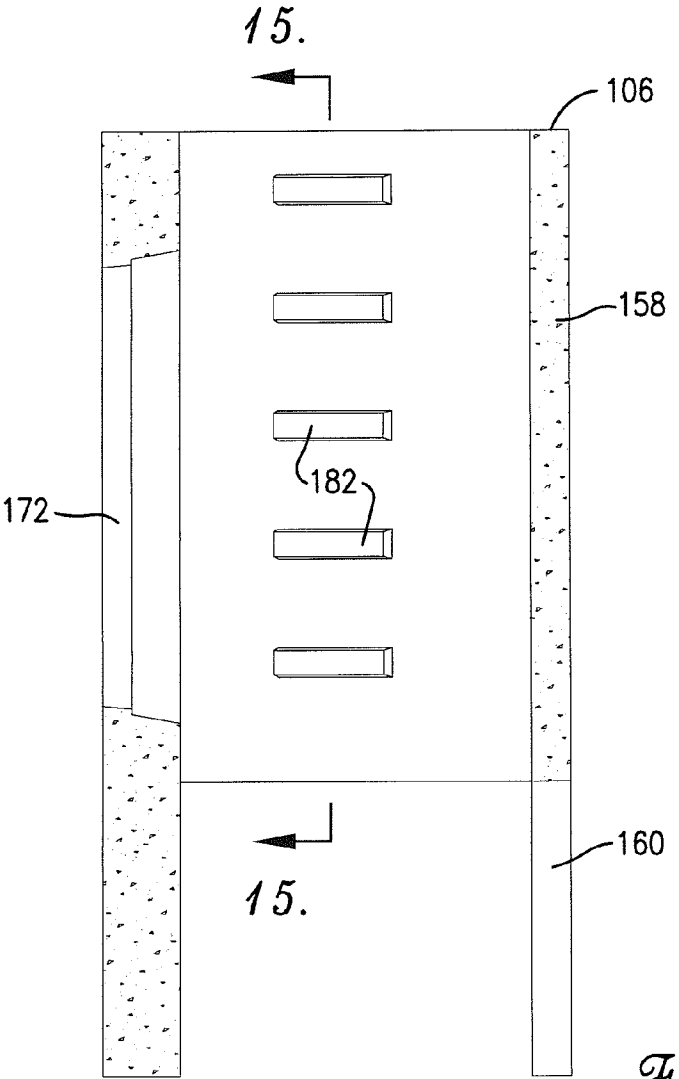
FIG. 14 is a vertical cross-sectional view of a foundation wall and window well wall similar to FIG. 9 showing the steps and increased height and thickness of the window well wall.

As illustrated in FIGS. 11, 12, 13 and 14, the window well forming panel system 100 hereof can be selectively configured to provide a window well wall 106 of various configurations. For example, as shown in FIG. 11, two sets of modules 108 and 110 can be stacked atop modules 108A and 110A which have a similar configuration when viewed in plan but may be of different heights than the modules 108 and 110. The illustrated configuration of the window well forming panel system 100 in FIG. 11 includes not only the addition of modules 108A and 110A to provide a window well wall 106 of greater height, but also the use of filler panels 124 positioned to extend the outer sections 114 and 118 away from the forming panels 170 adjacent thereto. That is to say, by using filler panels 124 extending substantially perpendicular to the forming panels 170 to connect to the second feet 176 of the outer sections 114 and 118, an additional thickness can be provided to the window well wall 106. FIGS. 12, 13 and 14 show that the window well wall formed thereby is somewhat thicker than the window well wall in FIGS. 7, 8 and 9 where the filler panels 124 were not used to connect the outer sections to the adjacent forming panels, but rather where the second feet 176 of the outer sections 114 and 118 were co-planar with the adjacent forming panels. The difference between the window well wall of FIGS. 12, 13 and 14 is further indicated by the extended side ledge 274 which is formed as a result. However, it may also be appreciated that filler panels 124 may be oriented parallel and co-planar with the forming panel 170 but coupled to the first feet 166 of the so that the second feet 176 are coplanar with the forming panel 170. This placement of the filler panels 124, along with companion filler panels 124 placed adjacent the spacer panels 120 and 122, may be done to incrementally increase the width of the forming wall 106.

In accordance with the preferred method of the present invention, a foundation wall forming panel system 104 includes the use of conventional aluminum forming panels 102 placed side by side and opposed to one another using forming ties as is well known to those in the art. Such a forming panel system 104 is typically placed atop footings located below any frost line so that the resulting foundation wall 160 will not be damaged by heaving in the earth due to a cycle of freezing and thawing. Where a window is to be placed in the foundation wall 160, the forming panels 102 are configured to accept a window buck 272 therebetween, as illustrated in FIG. 2, so that concrete will flow therearound and leave a void or opening for the window. Reinforcing bar 288, steel mesh, or the like is used to between the opposed panels in order to provide increased strength, particularly in tension, for the resulting concrete wall as is well known in the art. At least a part of the reinforcing bar 274 or steel mesh preferably is positioned and extends from the volume 128 into the channel 174 as illustrated by the dashed lines to further integrate and strengthen the connection between the foundation wall 134 and the window well wall 106 after the concrete is poured and cured.

In the present invention, the window well wall forming system 100 is provided so that the window well wall 106 may be cast in place and provide added structural reinforcement. Footings are provided in the usual manner for the foundation wall 134, and in addition, a footing 178 is placed or poured at a desired depth and distance from the foundation wall 160 corresponding to the displacement or depth of the window well wall 106 from the foundation wall 160. While several conventional forming panels 102 may be employed along what will be the interior side of the foundation wall 160, forming panels 170 are coupled in combination with the forming panel modules 108 and 110 of the present invention so that concrete may flow from the volume 128 between the forming panels 102 and 170 and also into the continuous channel 174 located between the inner and outer sections of the modules 108 and 110 and between the spacers 120 and 122. Pins 276 and wedges 278 are typically employed as couplers for connecting the various modules, panels, spacers, fillers, feet and the like, as is well known in the art, and thus for clarity, only a small sampling of the number of such pins 276 are shown in the drawing. In addition, other couplers such as the latching bolt mechanism shown in U.S. Pat. No. 5,058,855, the entire disclosure of which is incorporated herein by reference, may be used in many instances instead of pins and wedges to couple adjacent panels and like forming members. The modules 108 and 110 are configured and operatively connected to preferably have the upper rails in substantially the same horizontal plane to one another, although it is to be understood that the depth of the concrete pour in the channel is largely determined by the contractor on site depending on how much concrete is poured into the volume between the forms 102 and 170 and then flows into the channel. The first and second feet of the respective inner and outer sections are designed to couple directly using pins and wedges or other coupler, or indirectly by including additional filler panels or the like as described above, to the adjacent forming panels 170 using pins and wedges or other couplers. Where the modules 108 and 110 are located lower than the upper rails of the forming panels 170, cap forms 212 are added atop the modules as shown in FIG. 1 and connected to span the space between adjacent forming panels 170 occupied by the modules therebeneath. Base plates 126 are coupled by pins and wedges, clamps or other similar fastening means to the bottom rails of the inner and outer sections to complete the modules 108 and 110, and the spacer panels 120 and 122 rest atop the footing 178 to form a pier 160 for supporting the window well wall 106 as shown in FIGS. 7, 9, 12 and 14. When the height of the concrete poured between the forming panels 102 and 170 exceeds more than about one foot above the tops of the upper rails of the modules 108 and 110, then additional base plates should be fastened atop the upper rails of the modules 108 and 110 to prevent overflowing.

Alternatives for forming steps in the window well wall 106 are described as above, including the use of step riser forms, flexible or other insets to form inset steps as in FIG. 16, or projecting steps which extend into the window well 184. It is to be understood that reinforcing bar or mesh is to be placed between the inner and outer sections and spacer panels, and which are tied by wire or the like into the reinforcing bars or mesh between the forming panels 102 and 170. Furthermore, when inwardly projecting steps are formed, then reinforcing bar or other reinforcing tie-ins to the reinforcing bars in the channel need to be employed to provide sufficient strength.

It may also be appreciated that the window well forming panel system 100 may be readily stripped from the cured concrete window well wall 106 by the construction hereof. After removal of the base plates 126 and after the filler panels 124 are removed, the spacer panels may be pulled in a direction generally perpendicular to their plane. The forming panels 170 are disconnected from the inner and outer sections, and pulled away from the foundation wall 160. The outer sections 114 and 118 do not form any acute angles with the concrete, and thus are readily removed. The inner sections 112 and 116, once any forming panels 170 therebetween are removed, may be pulled toward one another to shear away from the concrete window well wall 106. Thus, the resulting window well is open at the bottom for drainage, and supported at its outboard extreme opposite the window opening by the pier 160 to avoid the necessity for additional support if cantilevered from the foundation wall 134. In this regard, it may be appreciated that the window well wall 106 in fact contributes strength to the foundation wall, in that it is unitary with and poured contemporaneously with the foundation wall. It provides additional strength in the manner of an outrigger to brace the foundation wall 134 against loads applied in a direction perpendicular to the plane in which it lies. It further bridges across the window opening in the foundation to provide a further structural member where there is reduced material in the foundation wall.

Figure 24:
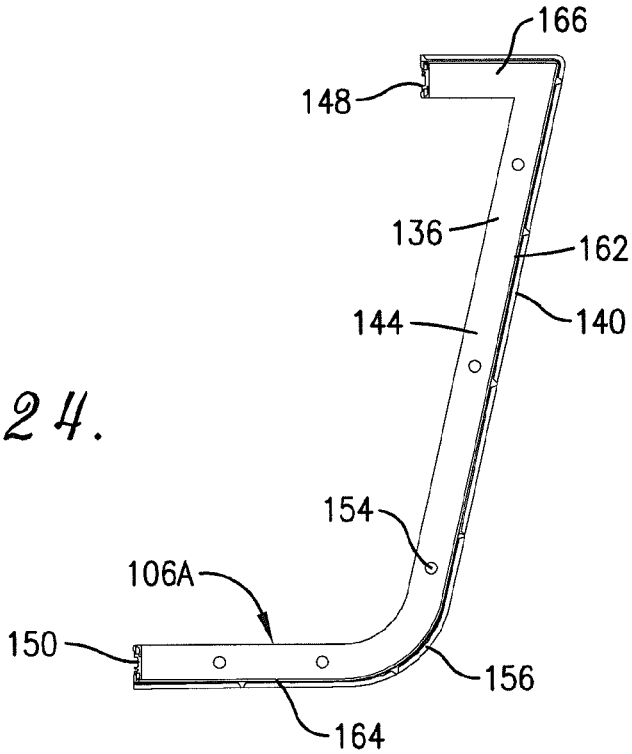
FIG. 24 is a top plan view of one of the angular inner sections of the forming panel modules using a face plate having a patterned concrete-receiving surface.

For reasons of aesthetics, the integrated system 104 of the present invention also contemplates the use of components such as inner or outer sections of the forming panel modules 108, 110 and the exterior forming wall panels 170 to be provided with a patterned or textured concrete-receiving surface of the face plate 138. By way of example, FIGS. 24 and 25 show an inner section 106A which has a face plate 138A which is stamped in a brickface pattern having staggered raised vertical segments 290 and raised horizontal segments 292. The segments 290 and 292 project outwardly a short distance from the face plate 138A to simulate the mortar joints between bricks in a wall. Other parts of the section 106A are the same as in the inner section 106 and numbered in like manner. It is also to be understood that the face plates of other forming panels, legs, spacers and the like may have face plates with complemental patterns whereby the foundation wall 134 and the window well wall may have a complemental appearance. Other patterns, such as a textured pattern for simulating a stucco surface, may be provided in the face plate 138A instead of the brickface pattern as shown.

In this manner, upon removal of the various modules and forming panels, the foundation wall 134 and the window well wall 106 may be provided with a surface with a brickface, stucco, or other appearance, with the appearance of the window well wall 106 being visually similar and compatible with the appearance of the foundation wall 134. Such an appearance may be more aesthetically pleasing to one viewing the inside of the window well wall 106 through the window placed in the window opening 134. The patterned or textured concrete-receiving surface may be provided in various manners, such as by stamping or forming the aluminum of the face plate 138A with the desired appearance, or alternatively by the use of a flexible member, made of material such as synthetic rubber, which has the desired pattern and which may be fitted over the face plate 138 of the desired sections prior to pouring of the concrete.

Figure 27:
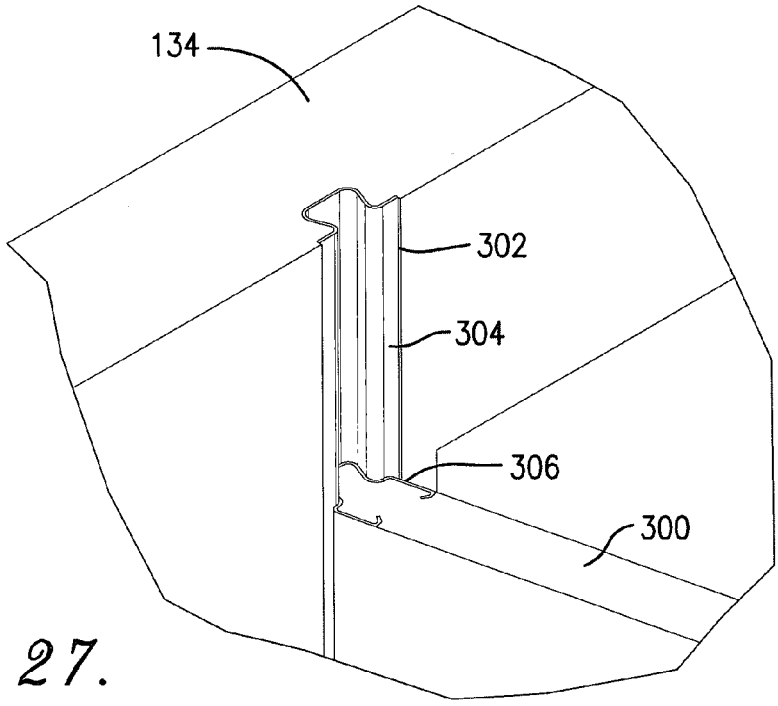
FIG. 27 is an enlarged fragmentary perspective view of the window well and wall of FIG. 26 showing profiles for connecting the window well for vertical movement relative to the wall.
Figure 28:
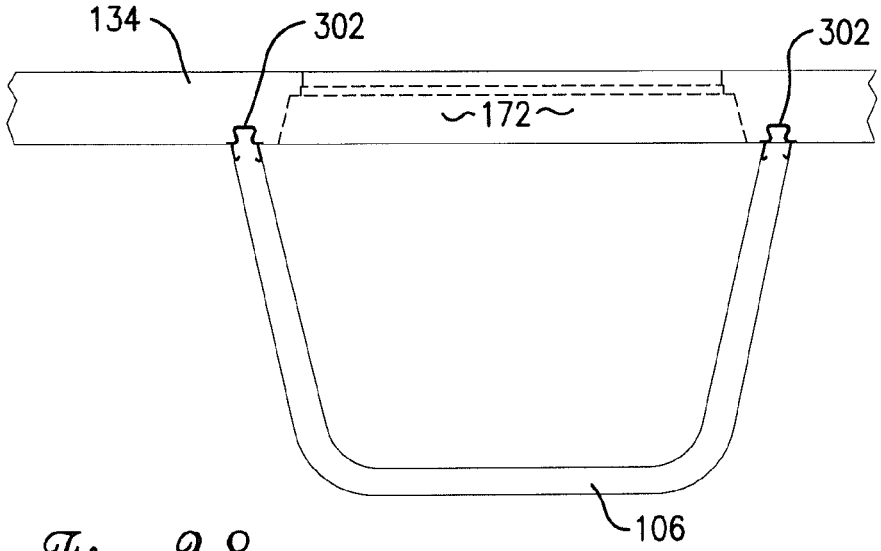
FIG. 28 is a fragmentary top plan view of the window well and wall of FIG. 26 showing its positioning relative to a window opening.
Figure 29:
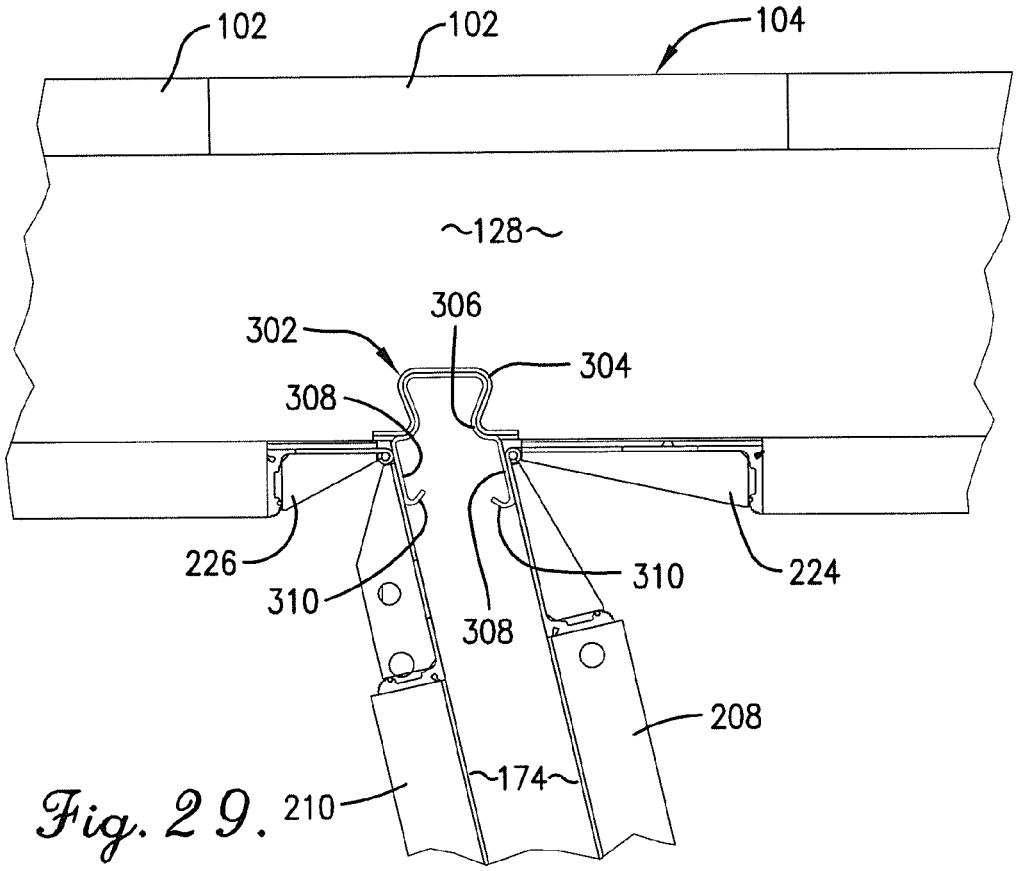
FIG. 29 is an enlarged fragmentary top plan view showing the use of the profiles of FIG. 28 in combination with the feet illustrated in FIGS. 22 and 23.

A further alternative method of providing a poured-in-place cementations window well wall 300 is illustrated in FIGS. 26, 27, 28 and 29. The window well wall 300 is poured-in-place using the window well forming panel system 100 or 100A. However, it has been discovered that it is possible to provide a poured-in-place window well wall which is capable of limited movement relative to the foundation wall 134 by the apparatus and method hereof. The window well wall 300 is permitted to shift vertically relative to the foundation wall 134 by providing a guide 302. The guide 302 may be provided of metal such as aluminum or steel, or alternative by a synthetic resin material. The guide 302 includes first and second elongated profiles 304 and 306 which are complementally configured in mating engagement to permit movement along a single upright axis, with the second profile positioned for receipt in the foundation wall 134 and thus having a longer length. In addition, the second profile 306 may be provided with legs 308 which may be fully embedded in the portion of the wall 300 formed by the channel 174, or as shown in FIGS. 28 and 29, may be positioned on the lateral sides of the window well wall 300 and include hooks 310 for enhanced retention to the concrete of the wall 106. As shown in FIGS. 27, 28 and 29, a modified dovetail configuration is useful in this regard. Opposing wall panels 102 and 170 are provided as described above and shown schematically in FIG. 29. In addition, the forming panel modules 108 and 110, or alternatively the forming panel modules 200 and 202 may be used as illustrated in FIG. 29. The guide 302 is sized and configured for placement between the adjacent feet 212 and 214 and also between feet 224 and 226, and thus across the channel 174 to prevent passage of concrete therepast from the volume into the channel. The guide 302 may be suspended from above or affixed to reinforcing steel or the like. In this embodiment, the window well wall 300 is not monolithic with the foundation wall 134, but has another advantage of being capable of relative movement to the foundation wall when the ground swells or heaves due to freezing or movement of plastic soil. Thus, the concrete must be poured into the channel 174 separately from the volume. After removal of the forming system 104, the window well wall 300 is capable of limited vertical movement as one profile 304 may slide longitudinally relative to the other 306.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art after reviewing the disclosure herein without departing from the spirit of the present invention. For example, while arcuate corners are preferred, the corners could be angled instead of arcuate and provide a defined intersection between the inboard and outboard legs of the sections of the modules. Also, the modules can be provided as sections which are continuously arcuate of the same or changing radii of curvature, rather than configured with legs which are straight and connected at a corner.

The inventors hereby state their intent to rely on the Doctrine of Equivalents to determine and assess the reasonably fair scope of his invention as pertains to any apparatus not materially departing from but outside the literal scope of the invention as set out in the following claims.

The invention claimed is:

1. A method of forming a cast-in-place window well wall of cementatious material comprising the steps of:

providing first and second forming panel walls each having a plurality of forming panels for forming a foundation wall and operatively connecting the first and second forming panel walls in opposition to one another to define a concrete-receiving volume therebetween;

positioning a window buck between the first and second forming panel walls to define a window opening and inhibit the passage of poured concrete into the window opening;

providing first and second forming panel modules, each of said modules including at least inner and outer sections complementally configured to one another to present concrete-receiving surfaces in opposition;

operatively coupling said first and second forming panel modules to each other and to one of the first and second forming panel walls to provide a concrete-receiving channel which extends outwardly from and fluidically communicates with said concrete-receiving volume, and is opposite to and extends laterally across said window opening to provide a window well between the channel and the volume;

pouring cementatious material into one of the channel and the volume and flowing concrete from the one of the channel and the volume into the other of the channel and the volume; and allowing the cementatious material to cure and removing the forming panel walls, the window buck, and the forming panel modules whereby a self-sustaining poured-in-place window well wall is monolithic with a wall formed by cementatious material received in the volume and positioned opposite to and in spaced relationship from the window opening.

2. A method as set forth in claim 1, including the steps of mounting a base member adjacent a bottom portion of the inner and outer sections of each of said forming panel modules in spanning relationship therebetween, and removing the base member after allowing the cementatious material to cure.

3. A method as set forth in claim 1, said window well wall including a side facing the window opening, and including the step of providing at least one step in the window-facing side of the window well wall.

* * * * *